US005695130A

United States Patent [19]

Csendes

[11] Patent Number: 5,695,130

[45] Date of Patent: Dec. 9, 1997

[54] METHOD AND APPARATUS FOR THE DRY GRINDING OF SOLIDS

[76] Inventor: Ernest Csendes, 514 Marquette St., Pacific Palisades, Calif. 90272

[21] Appl. No.: 423,326

[22] Filed: Apr. 17, 1995

Related U.S. Application Data

[63] Continuation of Ser. No. 80,461, Jun. 18, 1993, abandoned, which is a continuation-in-part of Ser. No. 907,368, Jul. 1, 1992, abandoned, and Ser. No. 983,019, Nov. 30, 1992, abandoned.

[51] Int. Cl.[6] ..... B02C 19/12; B02C 23/24

[52] U.S. Cl. ..... 241/19; 241/24.31; 241/48; 241/52; 241/56; 241/79.1; 241/162

[58] Field of Search ..... 241/19, 48, 52, 241/56, 79.1, 79.3, 78, 154, 161, 162, 24.31

[56] References Cited

U.S. PATENT DOCUMENTS

| | | | |
|---|---|---|---|
| 293,047 | 2/1884 | Mackey | 241/162 X |
| 911,913 | 2/1909 | Snyder et al. | 241/162 X |
| 1,524,651 | 2/1925 | Hapgood | 241/162 X |
| 2,752,097 | 6/1956 | Lecher | 241/19 X |
| 3,506,201 | 4/1970 | Engels et al. | 241/78 X |
| 3,690,571 | 9/1972 | Luthi et al. | 241/79.3 X |
| 4,690,338 | 9/1987 | Sayler et al. | 241/56 |
| 4,747,550 | 5/1988 | Jackering | 241/55 |
| 5,280,857 | 1/1994 | Reichner | 241/5 |

*Primary Examiner*—John M. Husar
*Attorney, Agent, or Firm*—Edward A. Sokolski

[57] ABSTRACT

A method and apparatus for the dry grinding of solids, comprises initial coarse grinding of the solids in a controlled vortexing of a fluidized bed and directing the solid fine particles generally upwardly into a vortex grinding zone and grinding the upwardly directed solid particles in the vortex grinding zone by passing a portion of the particles through the vortex grinding zone. The vortex grinding zone comprises at least one successively vertically disposed grinding stage comprising passing particles upwardly through at least one horizontal vortex zone of an annular gap, defined by a stationary plate with a circular aperture, hereafter cleaning up the upward moving product mix by eliminating coarser particles by gravity separation with a centrifugal expelling fan and subjecting the remaining part of the upwardly particles to the vertical vortexing of a rotating semipermeable means, defined by a rotating assembly containing a broad mesh screen therein.

53 Claims, 7 Drawing Sheets

METHOD AND APPARATUS FOR THE DRY GRINDING OF SOLIDS

This application is a continuation of application Ser. No. 08/080,461, filed 6/18/93, now abandoned, which application is a continuation-in-part application of U.S. application Ser. No. 07/907,368 filed Jul. 1, 1992 now abandoned and U.S. application Ser No. 07/983,019 filed Nov. 30, 1992 now abandoned.

BACKGROUND OF THE INVENTION

The present invention relates to a method and an apparatus for the dry grinding of solids.

The process of dry grinding is practiced today using hammermills, impact mills, ball mills, bowl mills or roller mills outfitted with internal classifiers which elutriate the desired fine fractions and return the coarse particles to a grinding chamber. For superfine and ultrafine grinding a similar arrangement is used with vibration mills, impact-attrition mills or jet mills. All of the present mills show poor efficiency at fine grinding, use excessive energy and exhibit very high wear.

In conventional mills, dry grinding of solids through mechanical impacting suffers from the disadvantage that the fine fractions of solids formed during the grinding process attach themselves electrostatically to the larger feed particles which cushion them from impacts during subsequent collisions and thus the efficiency of grinding drops off.

Although jet mills do not have the electrostatic problem of impact mills, because jet mills use high-pressure gases, they have high energy requirements, high maintenance, and limited capacity.

SUMMARY OF THE INVENTION

The main object of the present invention is to eliminate the disadvantages of the prior art systems and to provide a method and apparatus for the dry grinding of solids which yields micronized products in a safe, energy efficient, and environmentally acceptable manner, with low capital and operating costs.

The present invention uses controlled vortexing of a fluidized bed for the coarse and fine grinding of solids at low static pressures, followed by gas erosion and shearing of the particles in a vertical or horizontal vortex at high flow pressures to yield fine, superfine, and ultrafine products. In the present invention, limiting the size of the materials particles supplied to the comminuting zone for fine, superfine and ultrafine grinding is implemented by subjecting the particles mix to gravity separation by means of a centrifugal expelling fan and allowing the gas stream containing the sorted particles to enter an upward vortex grinding zone.

As opposed to conventional mills, the present invention accomplishes the instant removal of the fine particles by a strong uplifting air stream, thereby rendering the dry grinding more efficient. In the present invention, this is coupled with an efficient internal recycling of oversize particles to the initial coarse grinding stage by rotating semipermeable means.

As opposed to jet mills, the present invention does not use pressurized gases as a source of comminution energy, thereby greatly reducing capital costs, energy requirements, and maintenance, while allowing for scale-up in capacity.

The present invention employs rotors to create a controlled vortexing in a fluidized bed, which grinds primarily by autogenous impacting and attrition, and vortex generators comprising rotating semipermeable means, which generate a vertical vortex and grind primarily by gas erosion, and spinning discs, which generate a horizontal vortex and grind primarily by shearing.

The present invention can be used for the micronizing of coal or limestone and enables the use of low-cost micronized products for applications in energy raw materials, petrochemicals, environmental clean up of industrial and utility heating and power plants, pipeline transport of micronized solids, manufacture of construction materials, manufacture of new or improved materials such as weight-bearing insulators, manufacture of ceramics and superconductors, and in the production of metals and the metallurgy related to ore preparations, including precious metals.

Certain definitions relating to product size are used herein as follows:

| Product Size | Mesh (Tyler Mesh) | μm |
|---|---|---|
| Coarse | +270 | >56 |
| Fine | 270 & −270 | ≦56 |
| Superfine | 500 & −500 | ≦32 |
| Ultrafine | −500 to −4,500 | <32 to <5 |

In the course of this application reference is made to "micronized" solids, e.g., micronized coal and limestone. For these purposes "micronized" is defined as solids in the size range of 75%–400 mesh (75%<40 μm).

The present invention bypasses the costly problems associated with the direct impact of particles on the internal moving parts of grinding machinery as in impact mills which results in high power costs and excessive wear and maintenance for such devices. The present invention utilizes fast moving air cushions on which particles are ground by autogenous impacting and attrition, gas erosion, and shearing. The mechanism of the grinding in the present invention is designed to avoid collisions of the solid particles with the internal mechanism of the grinder. In the generation of a controlled vortexing in a fluidized bed, the rotors of the present invention perform like rotating fans, the rotor blades hitting the gas and the gas, in turn, transmitting this imparted kinetic energy to the particles swirling in the initial coarse grinding zone. Hence, the present invention could be practiced with cast polyurethane or polyurethane cladded/coated internal parts for the size reduction of abrasive ores and still exhibit low wear factors. The above explains the grinding efficiency, low power requirements, low wear, and low maintenance costs of the present invention.

The present invention is a fluid energy mill, i.e., a gas such as air, carbon dioxide, nitrogen or a noble gas acts as the working fluid and performs the transmission of energy necessary to accelerate the suspended particles which are subjected to size reduction. In conventional fluid energy mills, e.g., jet mills, a velocity head for the particles is created by high external pressures which impart to the feed particles their initial velocity. Such velocity head declines, however, after a short path, hence the inefficiency and high recycle ratios, as well as the high wear factors for jet mills. In contrast, the feed particles in the present invention are continuously reaccelerated by centrifugal forces, and their velocity head is renewed by air cushions energized by the mill's fast rotating rotor assembly. The present invention operates at low static pressures (up to 15" water column), but generates very high flow pressures by way of venturi effects propagated through the internal design of the apparatus.

Shaft speeds are in the range of 3,000 to 10,000 revolutions per minute (RPM).

Rotors in the grinding chamber of the present invention are the source of the centrifugal forces. The agitation of the fluidized bed of particles is accomplished by the turbulent air movement generated by rotors in conjunction with the flow enhancement bars mounted vertically on the inside walls of the grinder. The design of the rotor blades is selected to yield optimum conditions for the acceleration and controlled turbulence of the air cushions. Further, such design assures a minimum of energy consumption and the avoidance of collisions of the rotor blades with the feed particles. With the fine, superfine and ultrafine particles, collisions are avoided through boundary layer uplift.

The distance between the rotor blades and the casing wall of the grinder defines the width of the fluidized bed grinding zone. By shortening the rotor arms the width of the fluidized bed is expanded and the capacity of the initial coarse grinding zone enhanced.

The present invention operates on the vortex grinding principle with gas as the working fluid. For its initial size reduction, it utilizes the controlled vortexing of a fluidized bed wherein the centrifugal forces and the agitation of the vortex are created by a rotor assembly. The fluidized bed is supported by a strong uplifting air stream which also provides for the instant removal of the fines. A unique internal recycle mechanism accomplishes at low energy cost the return of the coarse or oversize particles which have been blown out together with the fines by the uplifting air stream, to the initial coarse grinding zone in order to blend them with the incoming feed stream into the vortex. For its main fine and superfine grinding, the invention utilizes two novel methods of comminution through vortex grinding—(i) rotating semipermeable means; and, (ii) spinning discs.

In its primary grinding process, the invention utilizes a fluidized bed at low static pressures and its secondary grinding proceeds at high flow pressures. In the latter process, fines may be converted to superfines and ultrafines, to the extent of ¼ to ½ of total fines produced. In this manner, the ratio of fines to superfines produced is in the range of 4 to 2 without an appreciable increase in energy cost over that of the initial grinding process. By varying the internal equipment design, the secondary grinding process may be suppressed. The grinding system may be operated with recycling of the working fluid, thereby rendering the system environmentally safe. Adding to its environmental benefits, the grinding system of the present invention operates at very low noise levels.

The controlled vortexing accomplished with the present invention allows for adequate heat dissipation during the coarse grinding in the fluidized bed and for close control of the size reduction process in the initial grinding chamber. Hence, the present invention overcomes the disadvantages of the prior art wherein grinders operate with uncontrolled vortexing which results in uncontrollable heat build up, lack of close control of the size reduction process and undesirable product alterations.

The use of rotating screens for size separation of solids is well known. Centrifugal sifters work on this principle and sort out the size of the ground product by allowing the passage of smaller particles through the screen openings and centrifugally rejecting the screened out coarser particles remaining thereon. The sifters operate at a speed of rotation of 30 to 120 RPM. If the speed of the sifter is increased over 1,200 RPM, the rotating screen of the sifter clogs and size separation ceases due to blinding of the screen. If a sifter with a 100 mesh screen is used in the grinding system of the present invention, at a speed of rotation of 1,500 to 4,500 RPM, the screen blinds instantly with fines and becomes inoperable. The solid particles originating from the vortex grinding in the fluidized bed of the initial grinding chamber and being carried upward by the uplifting gas stream are in the size range of 40 to 500 mesh.

One object of the present invention is the use of rotating semipermeable means, comprising an assembly with a rotating screen of broad mesh size which does not blind at high speed rotation. One use of the semipermeable means is for effecting the recycling of coarse or certain oversize particles suspended in a gas medium. This achieves a low cost recycle of oversize particles from the fast moving gas stream. The partitions in the fast rotating screen of 4 to 10 mesh size act as a statistical barrier to the slower moving particles. The rotating semipermeable means is not capable of recognizing differences in the particle sizes like a centrifugal sifter, and a 40 mesh particle could not be blocked out by a rotating sifter with a 4 mesh screen. The rotating semipermeable means is only capable of recognizing differences in particle velocities. The particles carried upward from the fluidized bed grinding zone attain their speed in the laminar gas flow depending on their Stokes drag which makes larger particles attain a lesser velocity than smaller particles. In turn, the slower moving particles are more probable to hit the partitions of the fast rotating broad mesh screen contained in the assembly of the rotating semipermeable means and be rejected by it to fall back to the initial coarse grinding zone. Hence, the ratio of the velocity of the rotating screen to the velocity of the ascending particles, ascending in the gas stream, determines which particles are blocked out by the partitions of the fast rotating broad mesh screen. By varying the velocity of the screen, the size of the particles passing through the fast rotating screen can be controlled. This explains that particle size has no relationship to the mesh size of the rotating screen in the present invention. A rotating semipermeable means can block out a 60 to 150 mesh particle depending on the above ratio of velocities of the circularly moving screen and the upwardly moving particle. In turn, the velocity of the particle will depend on the velocity of the uplifting gas current and the size of the particle which determines its Stokes drag.

The above phenomena of "statistical rejection" of particles through a system with a fast rotating screen of broad mesh size, due to their differing velocities, which underlies the internal recycling of the coarse or oversize particles to the initial grinding zone of the present invention, is limited to a system containing solid particles suspended in a fast moving gas stream. The above phenomena does not occur in dense media, i.e. in liquids such as water. The semipermeable means of the present invention operates efficiently at rotation speeds in the range of 1,500 to 10,000 RPM and most preferably in the range of 3,000 to 4,500 RPM. The semipermeable means of the present invention overcomes the difficulty experienced with screens in the prior art which are rendered blind and inoperable when rotating at high speeds.

Once out of the initial coarse grinding chamber, the particle sizes will be in the range of 150 to 500 mesh, or of lesser size and with such smaller particle sizes the drag forces will rapidly diminish. Hence, the velocity sorting of the rotating semipermeable means will become negligible at smaller particle sizes prevailing outside the initial coarse grinding chamber.

A further use of a semipermeable means outside of the initial coarse grinding zone, is for the grinding of fine solids through the creation of a vertically directed vortex. This delivers low cost superfine and ultrafine grinding. The high velocity gas passing through a rotating semipermeable means is split into gas bundles by the partitions of the broad mesh screen and the bundles are twisted by the momentum of the fast rotation of the screen, thereby generating a vertical spiral vortex. In the vertical vortex the particles are comminuted by gas erosion. The effectiveness of the comminution depends on the gas velocity in the vortex grinding zone which determines the residence time of the particle in the vortex, and the speed of rotation of the semipermeable means which determines the momentum of the turbulence affecting the gas bundles comprising the vortex.

Outside of the initial coarse grinding chamber the sole function of the rotating semipermeable means is that of an effective vortex generator. Uniquely, in the present invention, the vortex generators are placed in classifying chambers where gravity separation of the coarser particles in the upwardly gas stream is effected by centrifugal expelling fans. The sorted particles remaining in the upwardly gas stream are subjected to the vortex grinding generated by the semipermeable means. By repeating this process in stages, each stage comprising gravity separation and vortex grinding, the fine particles can be reduced to the ultrafine size. The grinding of fine particles to superfine and ultrafine products by gas vortices created by a rotating screen is unexpected and it occurs at a very low power usage. The screen is preferably composed of steel and has a mesh size in the range of 2.5 to 60, most preferably in the range of 4 to 10. The optimum mesh size of the rotating screen and the speed of rotation has to be selected experimentally. The vortex generation by the rotating semipermeable means is limited to a gaseous medium. In dense media, e.g. liquids such as water, vortices created by a rotating screen are localized and extinguished through friction.

Another use of a rotating semipermeable means is for effective elimination of solids from a high velocity, high temperature pressurized gas stream, with negligible loss of pressure and lowering of temperature. The semipermeable means for this application has a rotating screen with a mesh size in the range of 2.5 to 60, most preferably in the range of 4 to 10 and is composed of a metal or alloy, such as tungsten or steel, suitable for the temperature and speed of rotation to which it will be exposed. The ratio of the velocity of the rotating screen and the velocity of the pressurized gas stream has to be determined, at which an adequate velocity differentiation of the suspended solid particles takes place, to effect their blocking out by the rotating semipermeable means. Further clean up of the gas stream can be effected by gravity separation with a centrifugal expelling fan, following the passage of the gas stream through the rotating semipermeable means.

Another object is the use of an annular gap defined by a stationary circular aperture and a circular rotating disc placed in such aperture, for the grinding of fine solids in the annular gap through the creation of a horizontally directed vortex created by the rotating disc. The annular gap has a width of 0.5 to 6 inches, preferably about 3 inches, and a height of 0.5 to 6 inches. The effectiveness of comminution in the annular gap will depend on the residence time of the fine particles therein and prevailing shearing forces. Hence, the effectiveness of the annular gap will be determined by the velocity of the uplifting gas current and the speed of the rotating disc. The size reduction through the annular gap occurs at a very low power usage.

In the widely known application of rotating discs for the control of the particle sizes entering the comminution zone, the width of the annular gap (for fine and superfine grinding applications) would have to be in the range of 0.125 to 0.20 inches. With such small width of the annular gap, the vortex generation would become inoperable for accomplishing the size reduction through shearing and power usage would mount excessively. Uniquely, in the present invention, the vortex generator consisting of an annular gap is placed in a classifying chamber where reduced particles exiting the horizontal vortex of the annular gap undergo size separation in a field of gravity generated by a centrifugal expelling fan.

The present invention utilizes for its superfine and ultrafine grinding vortex generators comprising the rotating semipermeable means and the annular gap located within a classifying chamber wherein this secondary grinding is implemented at low power usage and low maintenance cost.

Hence, the present invention overcomes the disadvantages of the prior art wherein impact-attrition mills are used for the superfine and ultrafine grinding which is accomplished in the initial grinding chamber through uncontrolled vortexing in the narrow space between the rotors and the casing wall and through generation of intra-blade and intra-plate vortexing (in some cases enhanced by the generation of ultrasonic waves). All such vortexing and sonic enhancement of the prior art represent processes with low efficiency for fine grinding, high power usage and high maintenance cost.

A further object is the use of autogenous grinding media and/or arrangements yielding shearing or gas erosion of solids suspended in the gaseous working fluid for the purpose of the in situ modification of the reactive surfaces of said freshly ground solid particles with organic or inorganic chemical reagents. Reactivity of freshly ground surfaces and their modification with chemical reagents is well recognized, but processes for modification in the grinding systems of the prior art, e.g. impact-attrition mills or jet mills, occur in an uncontrolled fashion. Hence, the economics of the surface modification process is not favorable due to excessive use of reagents and the limits imposed thereby on the control of properties of the endproducts. In the grinding system of the present invention, generation of fresh surfaces through shearing in the annular gap can be closely controlled and a desired partial surface modification can be accomplished with economical use of the chemical reagents to yield a modified product with desirable surface properties.

Still another object is the use of vortex generators comprising a combination of a rotating semipermeable means, consisting of an assembly containing a rotating screen and an annular gap formed by a rotating disc in a circular stationary aperture for the purpose of superfine and ultrafine grinding of solids at low power usage. Uniquely, such combination of vortex generators is used in the present invention within a classifying chamber wherein gravity separation by a centrifugal expelling fan sorts out the size of the particles exiting the horizontal vortex of the annular gap, prior to allowing the cleaned up gas stream with the reduced particles of the desired size to enter the vertical vortex zone generated by the rotating semipermeable means. Repeated use of such combinations in a vertical stack of classifying chambers, results in the production of ultrafine products. The oversize particles eliminated in a given classifying chamber are externally recycled to the preceding classifier chamber in the vertical stack for the purpose of further size reduction through vortex grinding.

A still further object is the use of a grinding system consisting of a chamber with rotors for the initial coarse and fine grinding of solids in a controlled vortex of a fluidized bed grinding zone with an additional grinding zone available for the superfine and ultrafine grinding of said solids with vortex generators comprising a rotating semipermeable means and said annular gap, wherein a split power drive is provided which allows a very fast rotation of the screen and disc at low power usage. The screen with a split drive can rotate at more than 10,000 RPM, while the rotor assembly rotates at less than 3,200 RPM, with the system still retaining the characteristics of low power usage and wear. For the performance of the internal recycle function within the initial coarse grinding chamber, comprising the sorting out of the particles by their differing individual velocities in the uplifting gas stream, the rotating semipermeable means has to attain a speed of less than 4,500 RPM.

Another object is a system wherein the rotor assembly is covered with rubber, polyurethane or other plastics materials, or the rotor assembly is formed by casting these parts from such materials. Alternatively, the rotor assembly can be coated with ceramics (e.g., chromium carbide, tungsten carbide) or aluminum oxide.

A further object is a system wherein the walls of the system and the rotating screen and disc are coated with rubber, polyurethane, other plastics materials, ceramics, or aluminum oxide.

These and other objects and advantages of the present invention are achieved in accordance with the present invention by a method for the dry grinding of solids comprising steps of directing solid fine particles generally upwardly into a vortex grinding zone and grinding the upwardly directed solid fine particles through vortex generators situated in the vortex grinding zone by passing a portion of the particles through the vortex grinding zone, the vortex grinding zone comprising at least one successively vertically disposed grinding stage comprising passing particles upwardly through at least one of rotating semipermeable means and an annular gap defined by a stationary plate with a circular aperture therein and a rotating circular disc in the circular aperture.

The step of passing particles upwardly through said rotating semipermeable means comprises passing particles through a fast rotating screen. The screen is no coarser than 2.5 mesh, preferably has a mesh size in the range of 2.5 to 60, and most preferably has a mesh size in the range of 4 to 10 and is rotated at a speed in the range of 1,500 to 10,000 RPM, and most preferably in the range of 3,000 to 4,500 RPM.

The step of passing the particles through the annular gap comprises passing the particles through an annular gap having a width of from 0.5 to 6 inches, preferably about 3 inches, and a height of 0.5 to 6 inches.

Preferably, each stage comprises passing the particles through the rotating semipermeable means and thereafter through the annular gap. For the sorting of particle sizes exiting the annular gap, the upward gas stream with its suspended particles mix is subjected to gravity separation by a centrifugal expelling fan, and the upwardly gas stream, with the sorted particle sizes, is allowed to enter the vertical vortex grinding zone of the rotating semipermeable means.

In the initial coarse grinding chamber, the process also comprises internally recycling by rotating said semipermeable means at a sufficient speed to prevent the passage of a portion of the oversize particles therethrough. The process further comprises externally recycling by rotating a centrifugal expelling fan downstream of the rotating semipermeable means and providing a recycle channel receptive of particles from the rotating fan and having an outlet below the at least one vortex grinding stage.

The method further comprises the step of removing particles above the vortex grinding zone. The step of removing comprises rotating at least one centrifugal expelling fan downstream of the at least one vortex grinding stage.

In one embodiment, the method also comprises the step of initially grinding coarse particles into fine particles before directing the fine particles into the grinding zone containing vortex generators. The step of initially grinding comprises feeding solids into a chamber, forming a fluidized bed of the solids in the chamber by directing air upwardly in the chamber and creating a controlled vortexing in the fluidized bed to effect autogenous grinding. The step of external recycling comprises externally recycling particles into the fluidized bed.

The method can have a plurality of grinding stages containing vortex generators with external recycling of the oversize particles to a previous stage. The step of separating and removing preferably comprises removing in two vertically disposed removing stages for separating and removing particles of successively smaller sizes.

In another embodiment, the step of initial coarse grinding comprises generating a controlled vortex by using rotors.

The vortex generators comprising the rotating semipermeable means and spinning disc can rotate on a common shaft.

The step of grinding can be carried out in a nonreactive gaseous atmosphere in the presence of a chemical reagent to effect controlled surface modification of the solid particles.

The present invention is also directed to an apparatus for the dry grinding of solids, comprising means forming a vortex grinding zone containing vortex generators including at least one successively vertically disposed vortex grinding stage for the grinding of solid fine particles and means for directing solid fine particles generally upwardly into the vortex grinding zone. Said at least one vortex grinding stage comprises vortex generators containing at least one of rotatable semipermeable means and means forming an annular gap comprising a stationary plate having a circular aperture therein and a rotatable circular disc in the circular aperture and wherein the rotating semipermeable means and the annular gap are configured to pass a portion of the upwardly directed reduced particles therethrough and having a particle size separator for the products exiting the horizontal vortex zone of the annular gap, oversize particles being separated by gravity with a centrifugal expelling fan.

The rotating semipermeable means preferably comprises a rotatable screen no coarser than 2.5 mesh, preferably has a mesh size in the range of 2.5 to 60, and most preferably has a mesh size in the range of 4 to 10. The annular gap has a width of from 0.5 to 6 inches, preferably about 3 inches, and a height of 0.5 to 6 inches. Both of these vortex generators are used for the efficient grinding of the fine particles in the upwardly gas stream and reducing these particles to superfine and ultrafine size products.

In one embodiment, each stage comprises the rotating semipermeable means and means forming the annular gap downstream of the rotating semipermeable means and having a gravity separator for the oversize particles in the upwardly gas stream comprising a centrifugal expelling fan.

In another embodiment, the apparatus also comprises means for internally recycling coarse particles in the initial grinding chamber including means for rotating said semipermeable means at a sufficient speed to prevent the passage of a portion of the particles therethrough such portion comprising particles exhibiting lower velocity in the upwardly gas stream. The apparatus also comprises means for externally recycling comprising a rotatable centrifugal expelling fan downstream of the rotating semipermeable means in the initial coarse grinding chamber and a recycle channel receptive of particles from the rotating expelling fan and having an outlet below the at least one vortex grinding stage.

The apparatus also has means for removing particles above the initial coarse grinding zone. In one embodiment the means for removing comprises means for rotating at least one centrifugal fan downstream of the at least one grinding stage.

In a further embodiment the apparatus further comprises means for initially grinding coarse particles into fine particles before being directed into the grinding zone containing vortex generators. The means for initially grinding preferably comprises means for feeding solids into a chamber, means for forming a fluidized bed of the solids in the chamber including means for directing air upwardly in the chamber and means for creating a controlled vortexing in the fluidized bed to effect autogenous grinding. The external recycling comprises means for externally recycling particles into the fluidized bed.

In a still further embodiment, the apparatus comprises a plurality of grinding stages each of the stages comprising vortex generators and means for separating by gravity and externally recycling the oversize particles to a previous stage.

The means for removing preferably comprises means for removing in two vertically disposed removing stages for separating and removing particles of successively smaller sizes. The means for initially grinding preferably comprises rotors for generating a controlled vortex.

The vortex generators comprising the rotatable semipermeable means and rotatable disc preferably rotate on a common shaft.

In another embodiment of the present invention, a method and apparatus for the dry grinding of solids comprises means for feeding solids into a chamber, means forming a fluidized bed of the solids in the chamber by directing air upwardly in the chamber and means creating a controlled vortexing in the fluidized bed to effect autogenous grinding. This embodiment also preferably includes means for separating and removing particles above the fluidized bed and preferably means for recycling removed particles into the fluidized bed.

The removing of particles preferably comprises rotating at least one centrifugal expelling fan downstream of the fluidized bed and the recycling preferably comprises rotating a centrifugal expelling fan downstream of the fluidized bed and providing a recycle channel receptive of particles from the rotating expelling fan and having an outlet into the fluidized bed. The particles can be removed in two vertically disposed removing stages for separating and removing particles of successively smaller sizes.

The creation of a controlled vortexing preferably comprises rotatable rotors and the grinding can be carried out in a non-reactive gaseous atmosphere in the presence of a chemical reagent to effect a controlled surface modification of the solid particles.

A further embodiment of the present invention is directed to a method and apparatus for the clean out of particulates from a gas stream, comprising rotating at least one rotatable semipermeable means, directing at least one gas stream with solid particles through the at least one rotatable semipermeable means and removing particles not passing through the at least one rotating semipermeable means and removing the passing particles through a rotating expelling fan, downstream of the rotating semipermeable means.

The at least one rotating semipermeable means preferably comprises an assembly with a rotating screen, preferably a screen no coarser than 2.5 mesh, more preferably a screen having a mesh size in the range from 2.5 to 60 and most preferably a screen having a mesh size in the range from 4 to 10.

These and other objects and advantages of the present invention will become apparent from the following detailed description taken with the attached drawings, wherein:

DETAILED DESCRIPTION OF THE INVENTION

Figure 1:
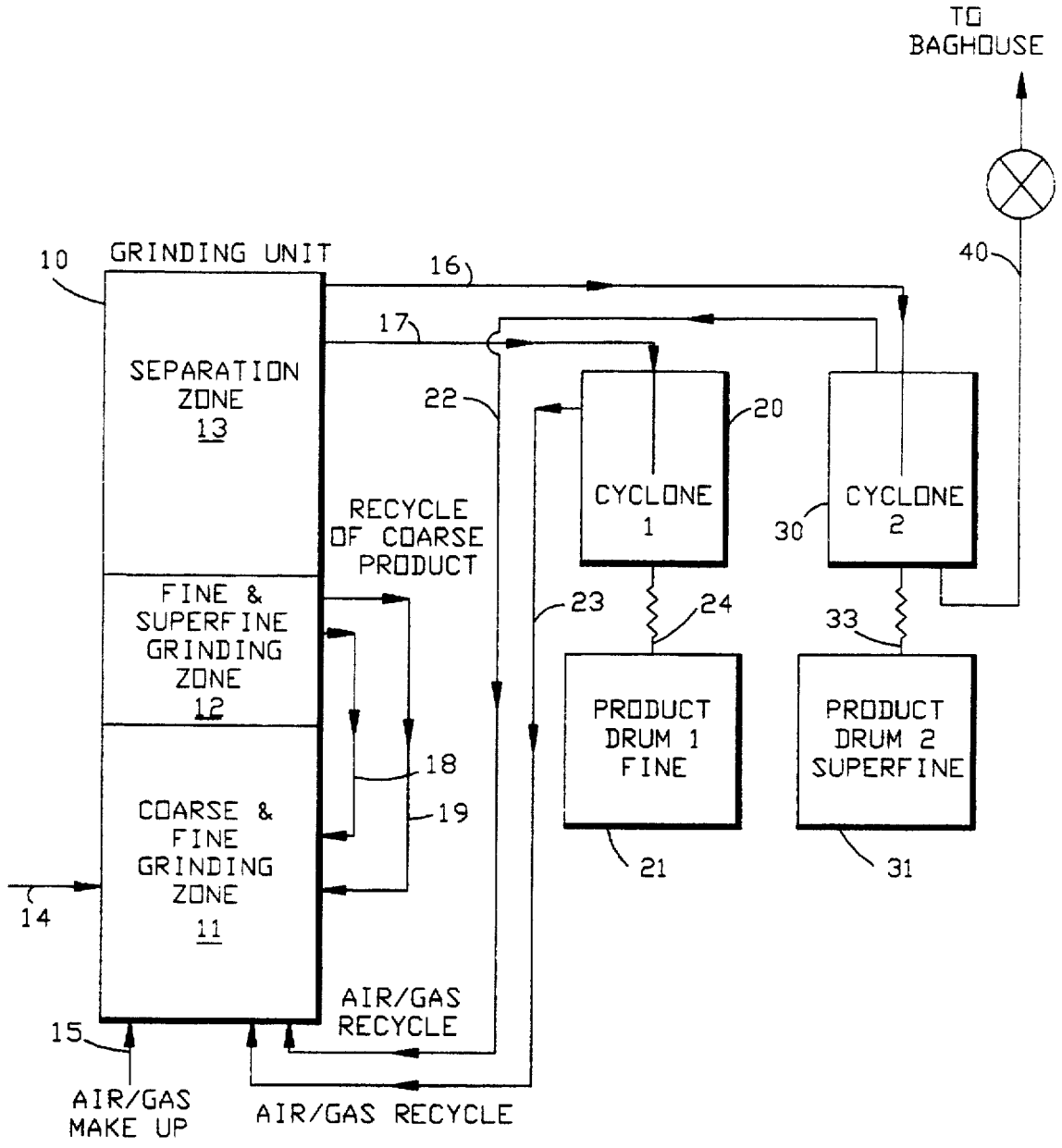
FIG. 1 is a schematic of an apparatus according to the present invention for carrying out the method according to the present invention.

FIG. 1 is a schematic view of the apparatus according to the present invention and an apparatus for carrying out the method in accordance with the present invention.

As shown in FIG. 1, grinding unit 10 includes a lower coarse and fine grinding zone 11 in the form of a chamber to which solid material is fed through feed inlet 14 and into which a gas, such as air, is fed from the bottom at inlet 15. Particles from lower zone 11 are fed by means of the gas flow into intermediate grinding zone 12 for further grinding. Intermediate zone 12 is provided with two recycling passages 18, 19 for the recycling of oversized particles back into lower zone 11. Particles ground in intermediate zone 12 are fed by means of the gas flow into upper separation zone 13. Upper zone 13 acts to separate out the final product (such as the superfine particles) which are outlet through line 16 to cyclone 30 for isolation of the superfine product. Fine particles are fed from the upper zone 13 through line 17 to the cyclone 20 for isolation of the fine product.

Cyclone 20 passes gas for recycling through line 23 into the bottom of lower zone 11 and transfers the particles through line 24 to product drum 21 for fine particles. Cyclone 30 recycles its gas through line 22 into the bottom of the lower zone 11. Superfine particles pass through line 33 into product drum 31. Alternatively, cyclone 30 may pass part or all of the carrier gas through line 40 to a collector baghouse.

Figure 2:
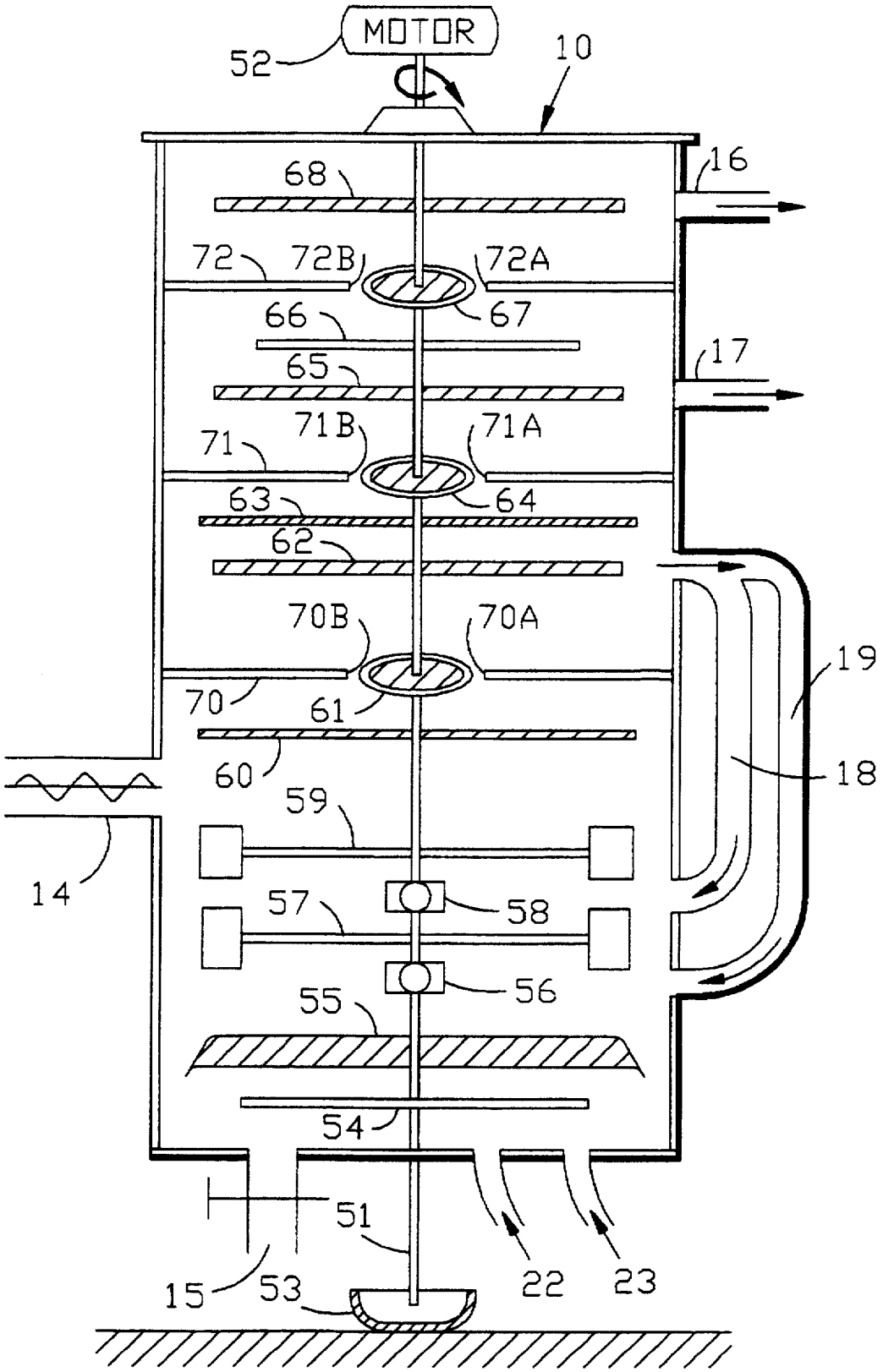
FIG. 2 is a schematic cross sectional view of a fluid energy mill shown in FIG. 1.
Figure 10:
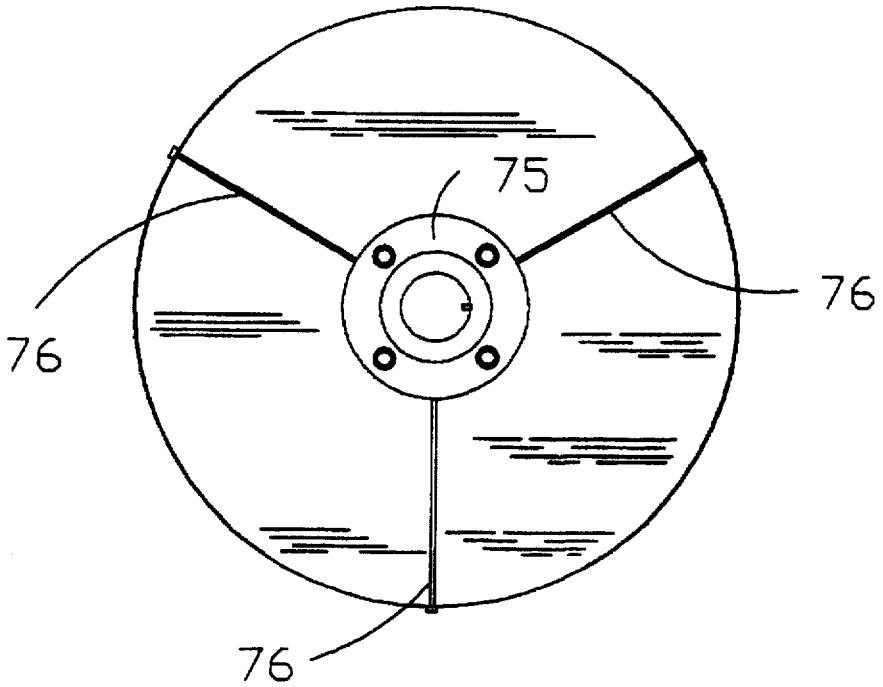
FIG. 10 is a top view of an internal bearing assembly in the mill of FIG. 2.

FIG. 2 shows grinding unit 10 of FIG. 1 in more detail. As shown therein, the grinding unit utilizes internal shaft 51 which is driven by motor 52 and sits in bearing 53 and which is responsible for the rotation of all of the internal parts 54–68 of the grinding unit. For stabilizing the rotating shaft against vibrations, one or several internal bearings are provided as shown in FIG. 10, these bearings 75 being fastened through steel spokes 76 to the outer wall of the grinder. For operating at speeds in excess of 4,000 RPM, a hollow shaft may be used to prevent the whipping of the shaft. The apparatus may be operated with a split shaft wherein the shaft in zone 11 which contains the rotors is operated at a lower shaft speed and the other rotating elements are operated at a higher shaft speed.

Lower zone 11 includes rotating plate 54 which is located under internal uplift fan 55. Plate 54 protects the fan from turbulence caused by the recycled gas streams entering through inlets 22 and 23. Fan 55 acts to provide an uplifting flow of air throughout the grinding unit.

Figure 5A:
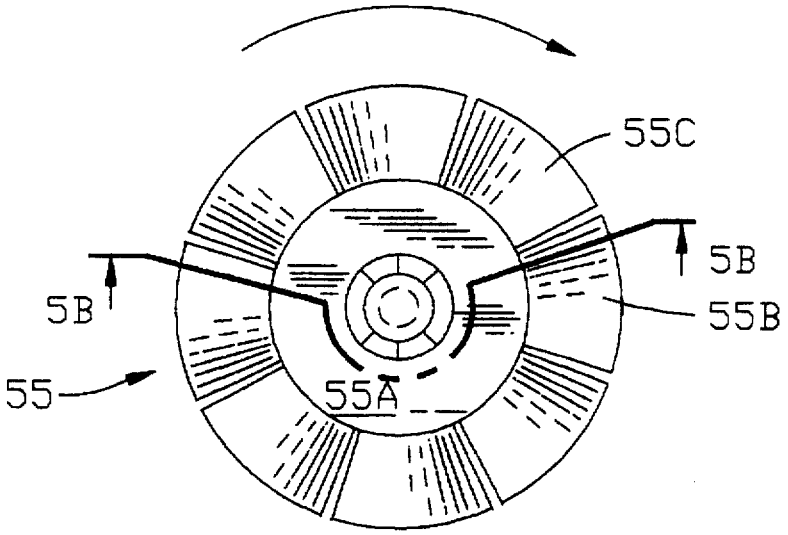
FIGS. 5A and 5B are top and sectional views of the centrifugal uplift fan shown in FIG. 2.
Figure 5B:
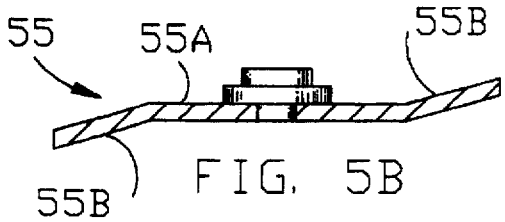

Uplift fan 55 is shown in more detail in FIGS. 5A and 5B. As shown therein, the fan includes a hub portion 55A and a plurality of blades 55B each of which are twisted to an angle of about 15°, alternating both above and below the hub to create the uplift action when rotated.

Above fan 55 are four rows of cross staggered coaxial twin rotors 56–59. The rotors are preferably flat plate arm or round rod arm rotors which are keyed into the shaft and hold a coaxial rotor blade at each end. The rotor blades are shown in more detail in FIGS. 6A and 6B.

Figure 6A:
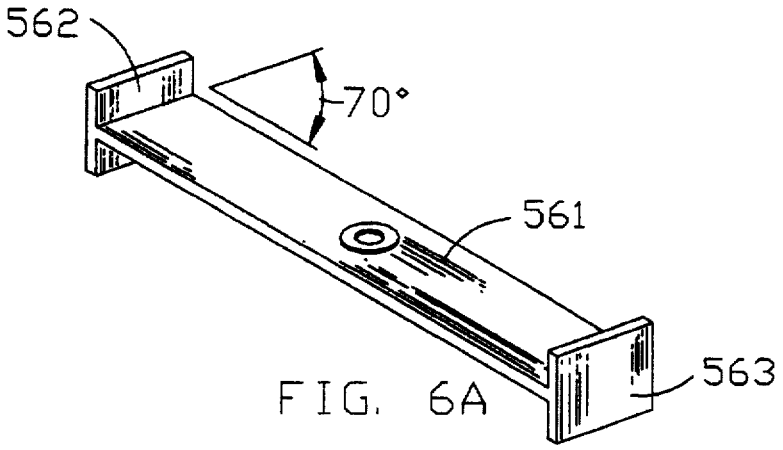
FIGS. 6A and 6B are top views of two different coaxial rotors for use in FIG. 2.
Figure 6B:
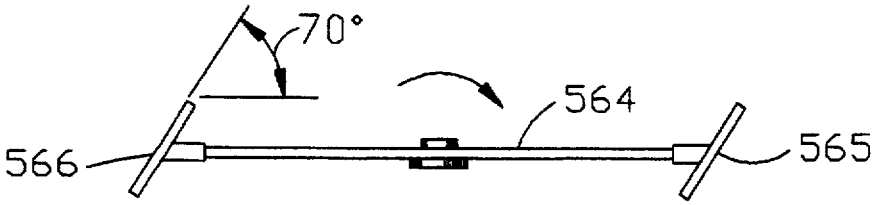

FIG. 6A shows a flat plate arm rotor having a flat plate 561 with rotor blades 562 and 563 at the ends thereof. The rotor blades are disposed at an angle of torsion of approximately 70° to the horizontal plane of plate 561. In FIG. 6B a round arm rotor is shown including the round arm 564 and rotor blades 565 and 566 at the ends thereof and disposed at an angle of torsion of approximately 70° to arm 564.

Figure 11:
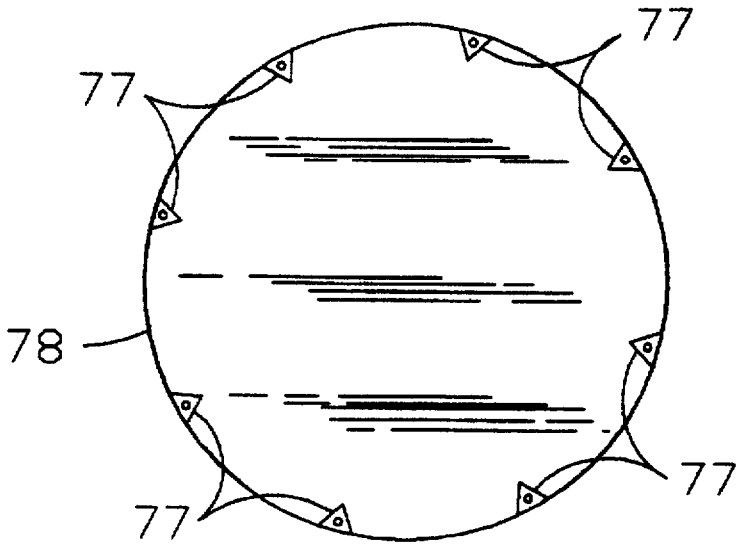
FIG. 11 is a top view of flow enhancement bars in the mill of FIG. 2.

Fan 55 generates a peripheral air curtain aided by skirts (not shown) attached to the lower end of flow enhancement bars 77 which are attached to wall 78 as shown in FIG. 11. Wall 78 may be covered with a rubber or polyurethane lining and has flow enhancement bars 77 affixed to it, preferably spaced every 3" to 7" along the wall. The rotor blades agitate the fluidized bed created by fan 55. The rotor blades may have different angles of twist or torsion angles against the horizontal plane, different angles of pitch, that is, tilts against the vertical plane, or may have rocking angles with respect to the rotor arms. Moreover the rotors can also have deflectors (not shown) to increase the turbulence of the vortex or to enlarge the grinding zones through the deflection of the air currents.

Figure 7A:
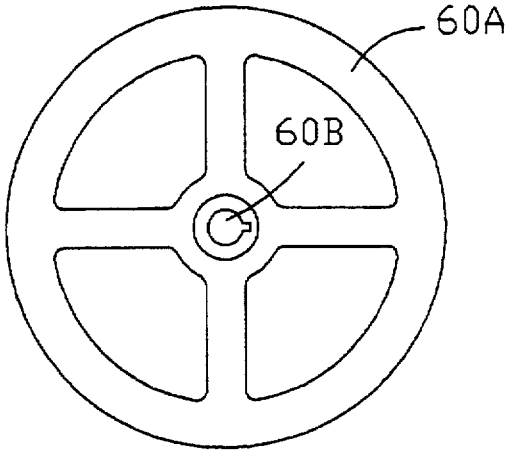
FIGS. 7A and 7B are top and elevation views of the rotatable semipermeable means shown in FIG. 2.
Figure 7B:
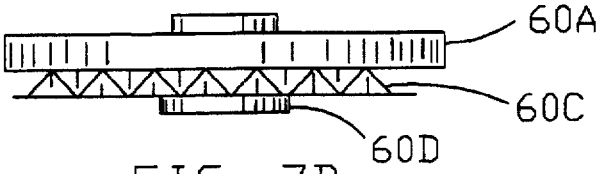

Disposed above rotor 59 at the beginning of intermediate zone 12 is rotatable semipermeable means 60 which acts to facilitate an internal recycle of coarse or oversize particles to initial grinding zone 11 as well as promote added fine and superfine grinding through its vertical vortex action on particles upwardly within intermediate zone 12. The structure of rotatable semipermeable means 60 is shown in FIGS. 7A and 7B.

As shown therein, rotatable semipermeable means 60 has a frame 60A including hub 60B which is keyed to shaft 51. On the lower portion of support plate 60A is screen 60C. The screen can be in the range of 2.5 to 60 mesh, preferably 4 to 10 mesh. The screen is preferably composed of steel. Beneath the screen is deflector 60D which prevents the passage of particles through the center of screen 60C. The deflector disc can vary in diameter from 4" to 10", depending upon the quantity and fineness of throughput that is desired.

Figure 8A:
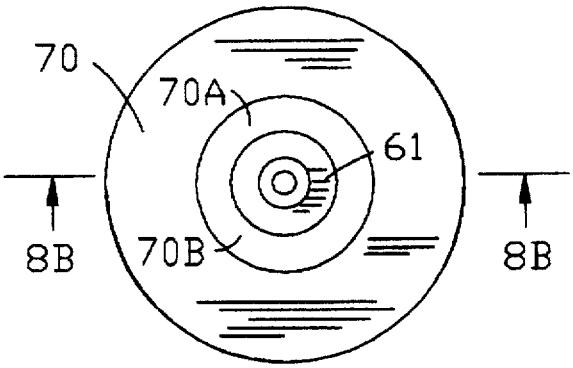
FIGS. 8A and 8B are top and elevation views of the spinning disc shown in FIG. 2.
Figure 8B:
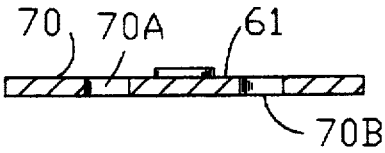

Particles passing through rotatable semipermeable means 60 must then pass through annular gap 70B between stationary plate 70 and spinning disc 61 disposed in aperture 70A of stationary plate 70. FIGS. 8A and 8B show the position of the spinning disc in the central aperture of the stationary plate in more detail, forming annular gap 70B. Annular gap 70B is 0.5" to 6" in width, preferably about 3", and has a height of 0.5 to 6 inches. The distance between means 60 and plate 70 is preferably greater than 2". Spinning disc 61 and stationary plate 70 are preferably in the same plane, but the plane of the disc can be up to approximately 1" above or below the plane of the plate. The spinning disc and stationary plate are preferably composed of steel.

Intermediate zone 12 includes centrifugal expelling fan 62 which acts to expel coarse or oversize particles which pass through the rotatable semipermeable means 60 and annular gap 70B between spinning disc 61 and stationary plate 70. These coarse or oversize particles are recycled through passages 18 and 19 to initial grinding zone 11.

Figure 9A:
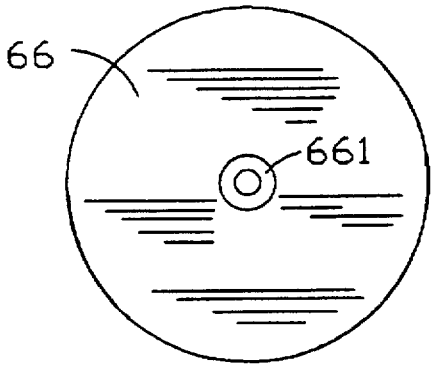
FIGS. 9A and 9B are top and elevation views of the rotating plate shown in FIG. 2.
Figure 9B:
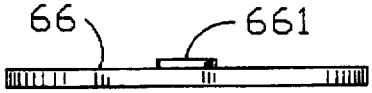

Disposed above fan 62 is rotatable semipermeable means 63 which has the same structure as rotatable semipermeable means 60. The particles having reached a small size are no longer rejected for recycle by the rotatable semipermeable means 63 which serves only for the function of vortex generation. Above means 63 is stationary plate 71 having spinning disc 64 disposed in aperture 71A and forming annular gap 71B. These have the same structure as that of stationary plate 70 and spinning disc 61. Disposed above spinning disc 64 is centrifugal expelling fan 65 which expels fine particles through outlet 17. Disposed above expelling fan 65 is rotating plate 66 which has the same structure as rotating plate 54 and which is shown in more detail in FIGS. 9A and 9B. As shown therein, the rotating plate has a hub 661 which is keyed to shaft 51 so as to rotate therewith. The purpose of plate 66 is to diminish turbulence upwardly within zone 13 and aid in the size separation effected by centrifugal expelling fans 65 and 68 through receptacle outlets 17 and 16. In the event a sharper separation by size of the fine or superfine particles is desired, the outputs from outlets 17 and 16 can be fed into an elutriation unit.

Disposed above rotating plate 66 is stationary plate 72 having spinning disc 67 rotating in central aperture 72A and forming annular gap 72B. The structure of this is the same as that of the previously mentioned stationary plates with rotating discs.

Disposed above spinning disc 67 is centrifugal expulsion fan 68 which expels superfine particles through outlet 16.

Lower zone 11 can operate as a closed atmosphere system, in which case inlet 15 and outlet 40 are closed. If wet feed is to be used, a flash dryer would be attached to inlet 15 to dry the feed to a moisture level of less than 4% while simultaneously pursuing the grinding. Arrangements have to be made for the exit of the steam produced in the course of this drying, by creating an outlet after exiting the cyclones, such outlets located at inlets 22 and 23. Inlets 22 and 23 in FIG. 1 serve to convey the gas recycled from the cyclones.

The incoming feed particles from inlet 14 are propelled to the circumference by the action of the gas cushions generated by the rotors 56–59 and there they form a fluidized bed of particles, kept in suspension by the continuing uplifting forces of the gas stream produced by fan 55.

The velocity head of the colliding particles in the circular fluidized bed is generated by the centrifugal forces of the rotors 56–59, and transmitted through the gaseous working fluid. Such velocity head is renewed with each revolution of the rotors which are attached to rotating shaft 51. Agitation of the fluidized bed and its control are effected by the rotating rotor blades and through selection of their torsion and pitch angles. The agitated fluidized bed is modulated by flow enhancement bars mounted vertically on the inside wall of grinding unit 10 which force the particles into "confined pockets" and exert a "venturi pumping" action on them, through the fluctuations of the flow pressures.

The particles are swept out of the circular fluidized bed by the continuing upward air curtain generated by fan 55 and reinforced by a helical uplift of the gaseous working fluid created through the cross staggering of the rotor pairs 56–59.

In terms of forces exerted on the particles in the lower zone, the centrifugal forces created by the rotating rotors will most affect the larger particles, propelling them to the outer periphery, while drag forces will keep these particles suspended in the vortex zone, provided the uplifting currents are maintained at constant velocity. Once the particles lessen in size, due to autogenous impact, friction, shearing, or erosion, they will reach a reduced size range where the effect of the centrifugal forces falls off. Hence, they will move to the inner perimeter of the swirling vortex. With the particles having reached a smaller size, the drag will decrease to the point where flow dynamics of the uplifting current take over and carry such reduced particles toward rotatable semipermeable means 60.

The rotatable semipermeable means acts by fostering a more effective internal recycle of the oversize particles, through "statistical rejection". In addition, it interferes with the passing gas stream by splitting the gas bundles and twisting them, thus producing vertically directed forces of a vortex which create additional fines primarily through gas erosion and shearing. At higher shaft speeds, the effectiveness of the rotatable semipermeable means for fine grinding is considerably increased.

Spinning discs 61, 64 and 67 placed in central apertures 70A, 71A, and 72A of stationary plates 70, 71, 72 cause venturi effects and high flow pressures. Thus, superfine grinding results primarily through enhanced circular shearing forces of a vortex acting upon the fine particles.

For a given feed rate and rotor velocity, there exists for a vortexing fluidized bed a maximum density of its particles population which optimizes the effects of the vortexing energy when applied to the comminution of such suspended particles. In the present invention this maximum density value can be obtained, and the optimum controlled vortexing effect maintained, through adjustment of internal design and operating variables. Consequently, the present invention, using a controlled vortexing of the fluidized bed, provides a most effective transfer of the input energy through a gaseous working fluid to the actual comminution of the feed particles.

Figure 3:
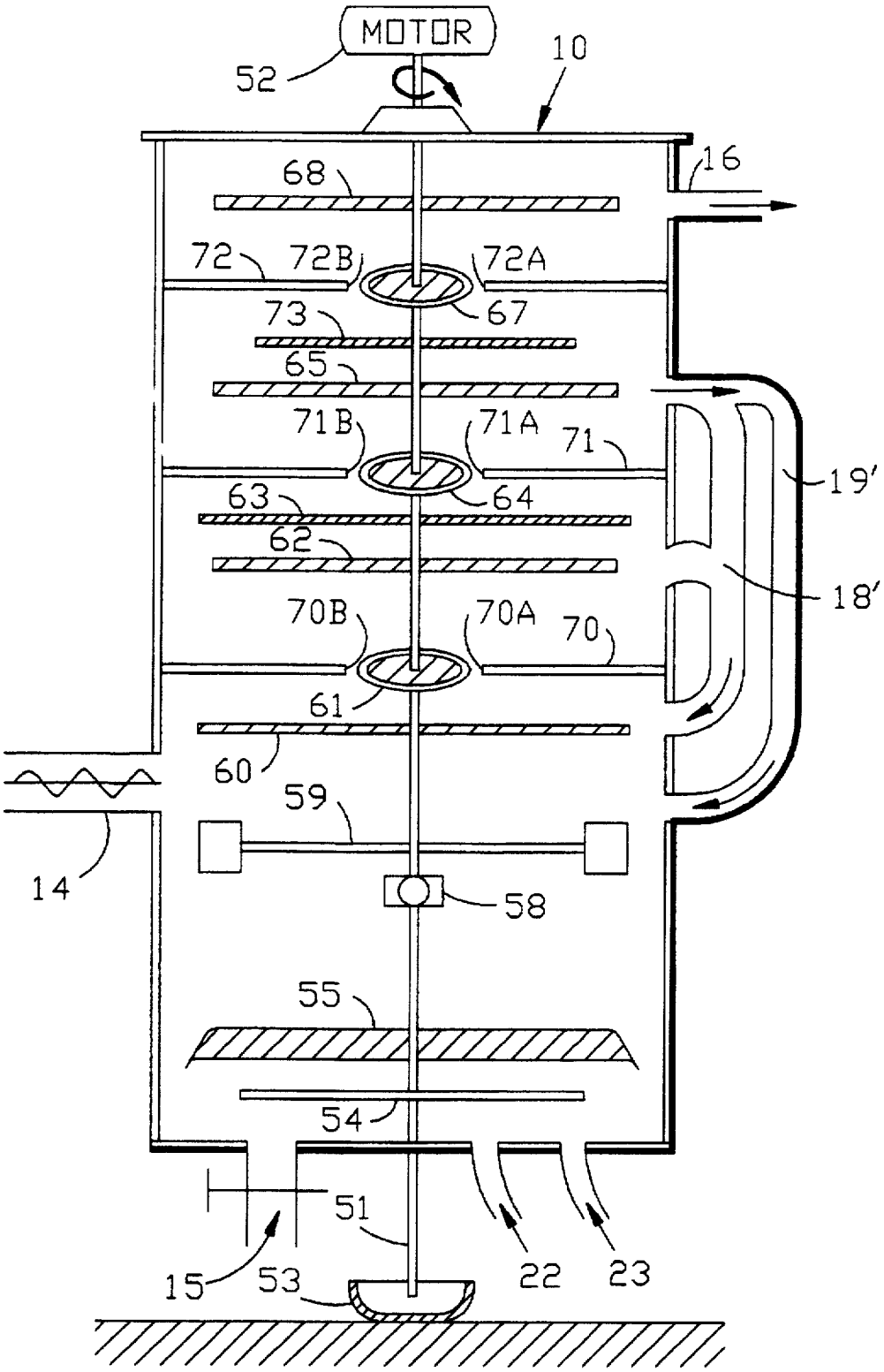
FIG. 3 is a schematic cross sectional view of a fluid energy reformer according to the present invention.

For upgrading the performance of existing grinding circuits which utilize ball mills, bowl mills, roller mills or other impact devices and introduce at low cost the ability for enhanced fine and superfine grinding, the fluid energy reformer of FIG. 3 can be used. In this Figure, like numbers refer to like elements. It differs from the embodiment of FIG. 2 in that the lower zone is used primarily for feed preparation and has only two rotors, and external recycle of product occurs from the intermediate grinding zone through lines 18' and 19' back to the fluidized bed to yield an end product of fines or superfines as specified. The fluid energy reformer uses rotating semipermeable means 73 in FIG. 3 as a vortex generator instead of plate 66 in FIG. 2. Similar to the embodiment of FIG. 2, the fluid energy reformer utilizes rotating semipermeable means 60 for a most effective internal recycling of the oversize products in the initial coarse grinding chamber and rotating semipermeable means 63 and 73 and spinning discs 61, 64 and 67 as vortex generators for enhanced fine and superfine grinding. The superfine grinding in the fluid energy reformer may be suppressed or accelerated through selection of the inserts and internal mill adjustments.

As a retrofit, the fluid energy reformer would take the end products of an existing grinding circuit and utilize them as feed material.

Figure 4:
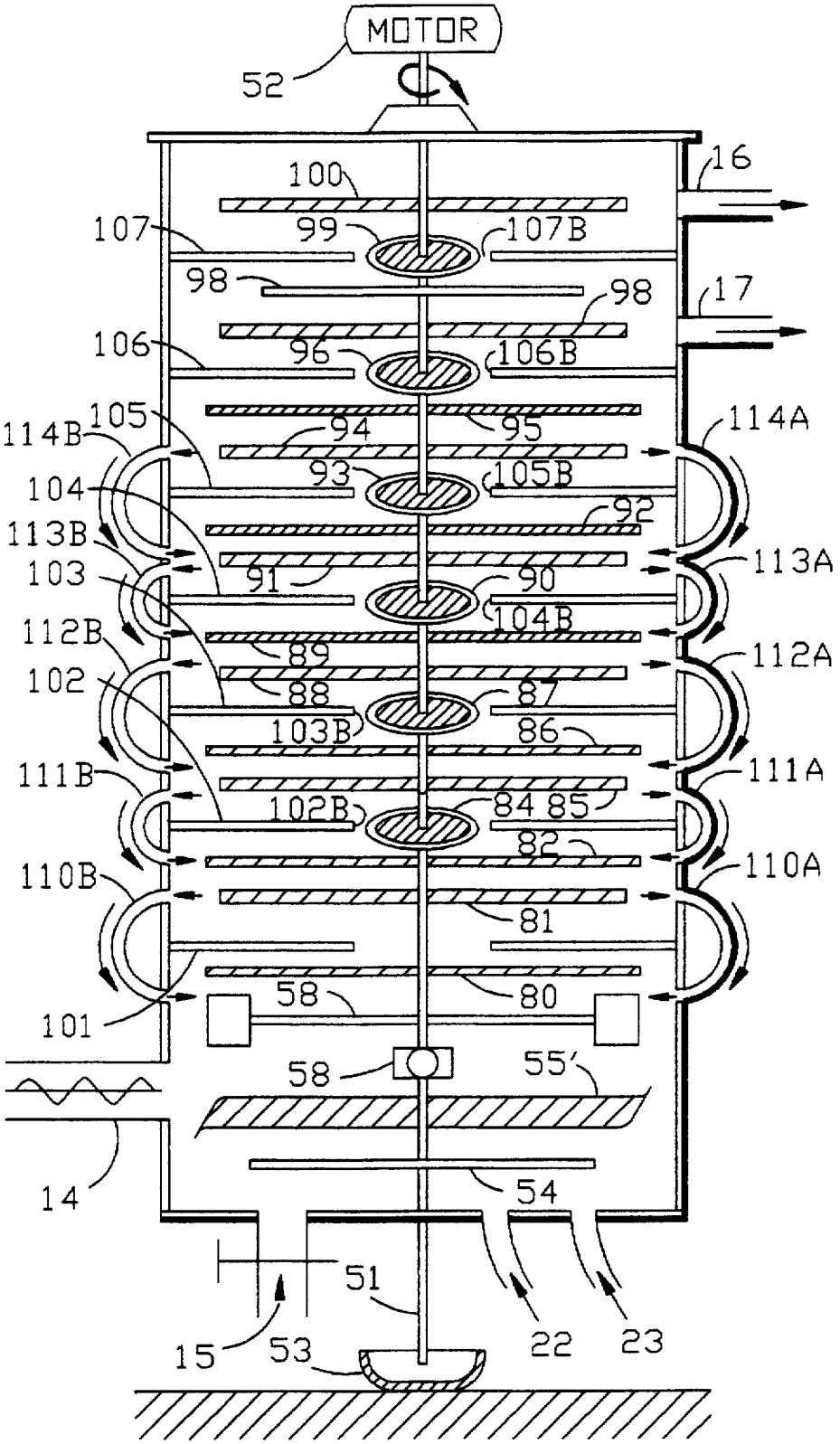
FIG. 4 is a schematic cross sectional view of a fluid energy ultrafine reformer according to the present invention.

The ultrafine reformer shown in FIG. 4 is intended as a low cost and efficient ultrafine grinder, utilizing the enhanced fine, superfine, and ultrafine grinding ability of the vortex generators comprising the rotating semipermeable means (80, 82, 86, 89, 92 and 95) and spinning discs (84, 87, 90, 93, 96 and 99). The effectiveness of this arrangement is due to the use of stages wherein consecutive recycling of the oversize products at each stage is effected by gravity separation through centrifugal expelling fans (81, 85, 88, 91 and 94) and conveyance of the expelled oversize products to the next lower stage through recycle channels (110A–114A and 110B–114B), thereby multiplying the effect of the ascending vortex generators comprising rotating semipermeable means and spinning discs arranged in a vertical stack. Outside of the initial coarse grinding zone 11, the particle sizes of solids in the upwardly flowing gas stream are diminished sufficiently and any internal recycling effected by the rotating semipermeable means becomes negligible. Hence, in the ascending stages of the ultrafine reformer, the rotating semipermeable means act solely as vortex generators.

The enhancement of ultrafine size reduction through the use of stages and consecutive recycling at low power usage is unexpected.

The ultrafine reformer of FIG. 4 is a low pressure size reduction device which will operate at high shaft velocities with a low energy usage. The ultrafine reformer generates high flow pressures at low static pressures, and thereby effectively accomplishes the reduction of a 270 mesh (56 μm) feed material to a 4,500 mesh (5 μm) or lesser size end product as specified.

In FIG. 4, like numbers refer to like elements. Above rotors 58 and 59 is rotatable semipermeable means 80 followed by stationary plate 101. This is followed by a series of five stages consisting of centrifugal expelling fans 81, 85, 88, 91 and 94, rotating semipermeable means 82, 86, 89, 92 and 95, stationary plates 102-106 and spinning discs 84, 87, 90, 93 and 96 forming annular gaps 102B–106B. The stages have recycling paths 110A–114A and 110B–114B. At the top are the superfine and ultrafine separators including expelling fans 97 and 100, rotatable plate 98, spinning disc 99 and stationary plate 107 forming annular gap 107B. Expelling fans 97 and 100 expel particles into outlets 17 and 16.

The lower zone is for the feed inlet where the incoming feed through 14 is suspended through the uplift forces of centrifugal fan 55' and the vortex action of the cross staggered rotors 58–59. Thereupon, the particles are subjected to the vortex action of rotatable semipermeable means 80 and are propelled into the series of stages. In addition to gas inlet 15 at the bottom of the feed inlet chamber, there are inlet ducts 22–23 which return the gas from the cyclones (after passing through a booster box, not shown, for pressurization, if needed).

The intermediate zone for superfine and ultrafine grinding is divided into five stages. Each of these stages submits the incoming particles to the consecutive action of vortex generators comprising rotating semipermeable means, and spinning discs in ascending order. Each stage has a centrifugal expelling fan associated with it serving to eject the oversize product fraction after it exits from the horizontal vortex of the annular gap through the recycle outlet ducts to the next lower stage. Hence, gravity separation sorts out the solid fractions and limits the size of particles which enter the consecutive vortex grinding zone with the vertical vortex generator comprising the rotating semipermeable means.

The upper zone is for classifying and has centrifugal expelling fans 97 and 100 which eject the end products through outlet ducts 17 and 16 to the respective cyclones. If a sharper separation of particle sizes is desired, the outputs from outlets 17 and 16 can be fed into an elutriation unit.

The ultrafine reformer can have a 2 ft. diameter and 7 ft. height, with a variable power drive, facilitating shaft speeds of 3,000 to 10,500 RPM. The inserts of the reformer will be keyed into hollow pipe shaft 51. The unit's wall can be rubber lined and corrugated with flow enhancement bars every 3" to 7" along the circumference.

There is built-in flexibility in the fluid energy mill of FIG. 2, should it be desirable to use such mill for liberation of particular components of the feed material in the form of coarse concentrates. In such event, the vortexing activity and recycling of the mill has to be limited. Accordingly, rotating plate 66 (FIG. 9A) is placed immediately above the rotating semipermeable means 60 (FIG. 2) to limit its role to internal recycling into the lower initial coarse grinding zone, while removing spinning discs 61 and 64, together with rotating semipermeable means 63 and centrifugal expelling fan 62, limiting the throughput or closing recycle ducts 18 and 19, and increasing the gas intake of the mill through 15. The coarse concentrates will exit at duct 17, while the fine fraction will be expelled through duct 16.

In the ultrafine reformer, the smallest particles will stream upward at relatively low static pressures (up to 15" water column) and are exposed to very fast vertically directed spiral cyclones generated by the rotating semipermeable means and traverse through high circular shearing zones generated in the annular gaps. The particle size reduction will occur through shearing and gas erosion. The centrifugal expelling fan, associated with each stage will provide the gravity separation and aid in returning the oversize particles to a next lower stage for further reduction. Thereby a platforming is effected to smaller-sized particles with each advancing stage facilitated by the vortex grinding zones generated by the rotating semipermeable means and spinning discs, and situated vertically higher in the ultrafine reformer.

The ultrafine reformer may be scaled up by increasing the diameter of the individual stages. The capacity may be boosted also by increasing the number of the ascending stages of the unit.

Due to the finer feed material and the use of the rotors primarily for feed mixing, the ultrafine reformer of FIG. 4 can operate at much higher shaft velocities than the fluid energy mill of FIG. 2 thereby increasing its capacity while still maintaining low power usage.

The feed material commonly utilized in fine grinding is of ½" to ⅛" size and is obtained at low cost with a variety of crushers. The fine grinders are generally air swept mills with attached classifier systems which return the oversize particles fraction to the grinding circuit for further fine conversion. A variety of impact mills fulfill this function—ball mill, pebble tube mill, hammer mill, bowl mill, roller mill and other impact pulverizers. The primary grinding in all these devices occurs by physical impact of the beater parts on the feed particles.

The utility of impact mills and their advantages are well recognized—high capacity operating units and effective size reduction. The disadvantages also are well recognized—high wear, high energy cost and low capacity for fine grinding. The attempts at extending the useful range of impact mills through vortex generation are well documented. The vortex impact mills or impact-attrition mills utilize rotary beaters with radial beater plates and covering discs. The direct mechanical impact of the particles on the beater plates and the attrition of particles through collisions with the surfaces of the apparatus are used for fine grinding. The value of the secondary effects of vortexing are well perceived—attrition through particle to particle collision, erosion and shear by high velocity gases in the vortex. The uncontrolled vortex zones generated in the impact-attrition mills are located in the narrow spacing between the rotor and the casing wall, the intra-blade or intra-plate areas within the rotor assembly. The vortex generation may be enhanced by corrugation of the casing wall and aided by ultrasonic vibrations generated by the attachment of vibrating blades or vibrating discs. The shortcomings of the vortex impact mills are high energy consumption, excessive wear, high heat build up, low capacity and relatively low yield for fines. Consequently, they represent a difficult scale up to larger operating units.

The design of the present invention as in FIG. 2 overcomes these disadvantages by utilizing for primary size reduction a controlled vortexing of a fluidized bed located at the circumference of the mill, wherein the particles impact upon each other, propelled by centrifugal forces initiated by rotors and effectively transmitted by the gaseous working fluid. The width of the fluidized bed may be increased by retracting the rotor blades (through shortening of the rotor arms) and accordingly increasing the speed of rotation and the velocity of the uplifting gas stream. Attrition occurs through autogenous collision of the particles at preferential angles to maximize the effect of the attrition at high shear rates. An efficient coarse and fine grinding is implemented by a very effective internal recycling of the oversize particles to the initial grinding zone 11 (FIG. 1) utilizing the velocity sorting effect of the rotating semipermeable means which rejects the slower moving particles, mostly of a larger size, carried upwardly with the gaseous stream. In contrast with the prior art, most of the fine and superfine grinding are not carried out in the primary grinding zone. In the present invention, most of the fine and superfine grinding is carried out in the vortex grinding zones wherein rotating semipermeable means and spinning discs act as vortex generators and enhance the fine, superfine, and ultrafine grinding through gas erosion and shearing at high flow pressures. Hence, the present invention exhibits low energy usage, minimal wear and minimal heat build up, and is characterized by very efficient fines and superfines production.

The ultrafine reformer as in FIG. 4 provides low cost ultrafine grinding through a new design which utilizes the generation of vertical spiral cyclones for the gas erosion of the particles in combination with horizontal circular shearing zones which shear the particles at high flow pressures and low static pressures. This vortex generating system utilizes rotating semipermeable means for generating the vertical spiral vortex zone and spinning discs for generating the horizontal vortex zone, both of these vortex generators acting as efficient size reduction devices for the upward moving fine particles in the gaseous stream and performing their comminution at low energy usage. At each stage, following the particles passage through the horizontal vortex zone, the oversize particles are sorted out by gravity separation effected by a centrifugal expelling fan. The eliminated oversize is externally recycled to the next lower vortex grinding zone for additional size reduction. The fine particles left in the upwardly gas stream, after the size sorting by gravity separation, proceed to the next vortex grinding zone for further size reduction, and in this manner the grinding effect is multiplied through ascending stages of the apparatus by platforming. The ultrafine reformer provides ultrafine grinding at low wear, low energy, and low capital cost.

Coarse ground limestone has long been a major industrial product utilized in the building industry, manufacture of cement, and agriculture. Finely ground limestone has been used in animal feeds and water treatment. Ultrafine limestone is an expensive product used as a paper sizing agent, pigment, industrial compounding ingredient and in environmental clean up.

Low cost superfine and ultrafine limestone would be very valuable in desulfurizing of flue gases and facilitate the use of low cost high sulfur coals of high calorific values. Micronized limestone is valuable in the compounding of extended coal fuels. Superfine dolomite and magnesite are valuable as desulfurizing additives to various heating oils, heavy crudes or petrocokes.

The present invention, when used to produce micronized coal/micronized limestone accomplishes the $SO_2$ and nitrogen oxides clean up at a low cost.

With the present system, micronized coal and micronized limestone can be introduced simultaneously through burner nozzles into a combustor. At this particle size, combustion will be instantaneous, it will proceed with similar velocity to oil and natural gas as the feed fuel for the burners. To allow for the reaction of the $SO_2$ with the limestone to be completed, it may require the recirculation of the exit gases around the boiler tubes. The complete carbon burnout, and the very fine size of the ash particles account for the lack of aggregation and adhesion of these particles, and should minimize the fouling, erosion, and corrosion of the conduction and convection surfaces. The complete carbon burn out lowers the heat losses through stack emissions and increases the thermal yield of the boiler. Further, it will produce a fly ash very low in carbon (less than 0.5%) and favored as a premium cement replacement and additive in concrete formulations.

In the use of low sulfur coals, e.g. Wyoming Powder River Basin coal, the heat content of the coal is lower when compared to Eastern and Midwestern high sulfur coals. Hence, using the same amount of pulverized low sulfur coal (size 75 μm, 200 mesh) results in the derating of the utility boiler system, due to the lower thermal yield of the combusted fuel. Using micronized low sulfur coal (size of 40 μm, 400 mesh) the combustion is greatly accelerated and the rating of the boiler is upgraded, due to its increased ability to burn a larger quantity of fuel per hour.

The micronized size of the fly ash particles should alleviate damage to the gas turbine vanes and blades. As an option, the hot combustion gases could be cleaned up from the flying particulates, without significant drop in pressure or temperature, by the use of a rotating semipermeable means.

Similarly, sulfur sorbents, alkali sorbents, and ash modifiers may be added to the hot combustion gases and cleaned in a similar manner by the use of a rotating semipermeable means. The clean up can be enhanced by inserting a centrifugal expelling fan after passage of the combustion gases through the rotating semipermeable means.

In the event an extended fuel (coal mixtures with natural gas, heating oil, heavy crude or water) should be used in a combustor, the precompounding of the fuel with micronized limestone should be sufficient, assuming that the mixtures have been stabilized, so that the $SO_2$ scavenger is available at the combustion site. The use of micronized coal in extended fuels (heating oil, heavy crudes, alcohol) intended for use in oil and gas burning utility boilers, without a substantial derating of such boiler capacity, is facilitated by the increased surface area of the micronized coal, its increased volatility and ease of combustion which give rise to a high volumetric heat release. These extended fuels may be combusted using burners accommodating a small excess of air thereby avoiding or minimizing the formation of nitrogen oxides.

For low pressure clean up of $SO_2$, the most economical means is the injection of micronized limestone into either the combustion zone or the existing hot flue gases. The output of the present invention will enable the burning of cheaper high sulfur fuels—coal and lignite, petrocoke, resid oil, heavy crude and asphaltene—due to the inexpensive $SO_2$ clean up by using micronized limestone/dolomite. Micronized iron oxide may be added to the limestone/dolomite as a fluxing agent to speed up completion of the reaction.

The micronized coal of high sulfur content, prepared in accordance with the present invention, may be used for addition to residual oils and heavy crude oils, prior to coprocessing such mixtures by high pressure hydrogenation (H-Coal, H-Oil, Flexicoke processes), to be converted into high value petroleum liquids (transport fuels, naphtha, gas oil) while removing and recovering the sulfur impurities as elemental sulfur. Micronized coal for these purposes exhibits a particle size of 80% less than 30 μm (525 mesh) and 20% less than 20 μm (875 mesh). Such oil-micronized coal mixtures will accommodate up to 50% of micronized coal in the system. The presence of such coal in the mixture results, in the hydrogenation process, in higher yields of petroleum liquids and-improved process economics.

Ultra clean coal is desired in certain applications of coal in extended fuels for internal combustion engines (passenger vehicle, truck, or diesel locomotive engines). For these purposes, the coal should be reduced to −400 mesh (<40 μm) then subjected to froth flotation to remove the ash material. The beneficiated coal would be dried, and submitted to size reduction in the ultrafine reformer to the size range down to <1 μm. A low cost clean ultrafine coal would represent an important substitute automotive fuel by itself, or in mixtures with gasoline, oil, methanol, MTBE (methyl-t-butyl ether), or in the form of a coal-water slurry fuel.

Modification of the surface of size reduced solid particles is of particular interest for their transport through pipelines or in their industrial use as fillers, pigments, absorbents, abrasives, cements, coal slurry fuels for engines with high pressure injection, or as intermediate raw materials for further processing.

The fresh surfaces created in autogenous grinding, through shearing and gas erosion utilized in the size reduction of particles in the present invention, display reactive sites, either in the form of mechanical radicals (i.e., reactive sites resulting from the breakage of chemical bonds within the molecular regions on the surface of the feed materials) or in the form of residual valences (i.e., active sites resulting from breaking of the crystal lattice structures on the surface of such feed materials). These reactive sites usually have a short life span and are saturated in the ordinary course of processing through oxygen or carbon dioxide present in the air, or through water molecules from moisture in the environment.

The present invention, with an inert atmosphere (e.g., the working fluid in the mill consisting of nitrogen or noble gases, and operated with complete recycling of the working fluid), allows for the in situ modification of the freshly ground and reactive surfaces with chemical reagents, both organic and inorganic chemicals, yielding valuable new materials for commerce and industry.

For the surface modification in the present invention, the chemical reagents are allowed to vaporize, if volatile, within the recycling working fluid of the system, or be dispersed as aerosols, if higher boiling or solid, and are diluted by the inert gases present in the working fluid of the system. For saturating mechanical radicals, the chemical reagents consist of alcohols (e.g., methanol up to stearyl alcohol), fatty acids (e.g., formic up to stearic acid) or vinyl compounds (e.g., vinyl alcohol, acrylic acid, acrylonitrile, vinyl chloride, styrene, butadiene), amines, ammonium salts, carboxamides, ureas and epoxides (e.g., ethylene oxide, propylene oxide, epichlorohydrin). For saturating residual valences, the chemical reagents consist of salts (e.g., alkali, earth alkali or basic metal halides or stearates, or ammonium salts).

The reduced solids with in situ chemically modified surfaces represent new compositions of matter which exhibit valuable properties—altered surface wettability and surface tension, lessened coherence between particles, free flow as dry powders, lower dynamic viscosity when suspended in hydrocarbon or aqueous media.

The in situ chemical surface modification in the present invention produces new micronized coal compositions which are useful in the formulation of extended fuels (i.e., coal slurries with alcohol, fuel oils, heavy crudes) or capable of being utilized as activated intermediates. The modified coal products exhibit better dispersion, lower viscosity at high coal loading in slurries (e.g., coal-water slurry fuels or extended fuels), improved storage stability, and less shear and erosive character.

Such modification is important for preparing micronized feed materials for pipelining of solids which show satisfactory rheological properties at high loadings of solids and hence realize lower transmission costs per ton of solid.

The in situ chemically surface modified micronized limestone is useful in the formulation of high sulfur containing fuels (heavy crudes, resids, bunker fuels, asphaltenes, high sulfur coals and petrocokes) for satisfactory compliance with environmental requirements upon their combustion.

Other surface modified micronized products encompass metallic ores and other minerals which will deliver "pre-reagentized" products for their subsequent beneficiation by various modes of dry separation (e.g., gravity, magnetic or electrostatic) and aqueous separations (gravity, froth flotation, or oil agglomeration).

Surface modification according to the present invention may be used in the grinding of fillers and pigments. In the case of fillers (e.g., carbon blacks, silicas, clays, calcium carbonates), the modified compounds exhibit better dispersion and superior reinforcing characteristics in polymeric media. In the case of pigments, the modified compounds exhibit better dispersion and color strength (i.e., tinctorial values).

For preparing the surface modified feeds for high temperature heterogeneous chemical reactions, the surface modification yields faster reaction rates and improved yields of the end product, resulting in savings in processing costs.

In the case of cement and stone, in situ modification of the micronized products results in improved storage, faster binding and better aging properties.

The apparatus of the present invention is compact and light weight and allows such grinders to be transported to production sites for the quick generation of fresh micronized powders. In this manner, instant cement may be produced from chipped clinker or mini-clinker. Presently used clinker formulations use slow-curing formulas to prevent the "set-up" of ground cement while stored. The process of the present invention will prevent the spoiling of ground cement by producing freshly made cement at building sites. Similarly, fast-curing formulas for cement clinkers may be used in the process of the present invention to yield fresh cement which allows for accelerated construction. The ability to produce fresh cement at building sites may result in substantial savings in grinding, packaging, storage, and transportation costs.

The autogenous grinding of the present invention results in a more economical liberation of desirable components of aggregate ores than can be accomplished with impact grinders. This is the case because autogenous grinding effects liberation of such components at larger particle sizes than does impact grinding. With impact grinding, a portion of the desired component is lost in the tailings, and grinding energy is wasted, due to the over-grinding necessary to accomplish the liberation of the desired component. For the foregoing reason, the present invention may be used economically for such things as the preparation of coal feeds requiring low cost liberation of pyrites and related inorganic sulfur compounds.

The present invention also permits differential grinding to effect separation of components in mineral aggregates, provided the grindability indices of the components are sufficiently different, due to the control of the vortexing, shearing, and erosion forces in the system. For example, precious metals ores could be concentrated by the dry differential grinding of placer deposits containing high concentrations of clay. Similarly, gold ores could be concentrated by the dry differential grinding of gold-bearing black sands. Dry differential grinding in accordance with the present invention may be used in the upgrading and separation of "wash coals" with high clay content after the drying of such feed materials prior to entering the grinder.

Micronization of solid reagents to powders of a size 80% less than 30 μm (525 mesh) and 20%–60% thereof less than 5 μm (4500 mesh) enables low cost manufacture of many micronized chemicals, including earth alkali, silicon, and heavy metal carbides (e.g., $MgC_2$, $CaC_2$, SiC, $Cr_3C_2$, $Fe_3C$, $W_2C$, $NiC_2$). This process is sufficiently low cost that it should not only decrease the present costs of manufacture of these carbides, but also enable new applications for them.

The preceding discussion describes generally some of the areas in which the present invention has application. The following are some detailed examples of specific uses.

EXAMPLES

1. Micronized Coal for Power Production. Coal is ground in accordance with the invention for direct firing into the combustion chamber of a boiler, wherein the coal is ground to a particle size of 80% less than 32 μm (500 mesh). The coal burns with a short bright flame like No. 2 fuel oil or natural gas. The carbon burnout is much faster and at >99%, and the dry flue gas loss is <6%, as compared to a 96% burnout, and a 9% dry flue gas loss, for a 75 μm (200 mesh) pulverized coal combusted in a shallow fluidized-bed system.

2. Clean Coal Fuel for Boiler Applications. A micronized coal fuel and a micronized limestone scrubbing agent (e.g., limestone or a mixture of limestone and a basic oxide) are ground in accordance with the invention for direct firing into the combustion chamber of a boiler, wherein the coal is ground to a particle size of 90% less than 32 μm (500 mesh) and the limestone is ground to a particle size of 90% less than 30 μm (525 mesh) and 15% thereof less than 5 μm (4500 mesh). The coal burns like No. 2 fuel oil, the carbon burnout is >99%, the dry flue gas loss is <6%, and the limestone scrubs >95% of the $SO_2$ and $NO_x$.

3. Clean Coal Fuel for Gas Turbine Applications. A micronized coal fuel and a micronized limestone scrubbing agent are each ground separately in accordance with the invention for direct firing of a gas turbine, wherein the coal and limestone are ground to a particle size of 90% less than 30 μm (525 mesh), 35% thereof less than 10 μm (2000 mesh) and 15% thereof less than 5 μm (4500 mesh). The coal burns like No. 2 fuel oil, the limestone scrubs >95% of the $SO_2$ and $NO_x$, and the micronized particulates from the combustion process do not erode or foul the gas turbine's vanes or blades.

4. Clean Coal Fuel for Gasification Applications. A micronized coal fuel and a micronized limestone scrubbing agent are each ground separately in accordance with the invention for combustion with oxygen in a high-pressure coal gasification chamber to produce a medium BTU gas, wherein the fuel and scrubbing agent are ground to a particle size of 80% less than 32 μm (500 mesh) and 25% thereof less than 20 μm (875 mesh). The resulting medium BTU gas may be utilized as fuel for a combustion turbine, may serve as fuel input for a fuel cell, or may be used as an intermediate in the manufacture of liquid fuels (e.g., methanol, gasoline, diesel) or chemical feedstocks. Compared to coarser coals, micronized coal gives faster combustion rates and results in increased capacity of the gasifier.

5. Clean Extended Fuel: Coal/Gas. A mixed fuel consisting of natural gas, micronized coal, and micronized limestone has the solid components each ground separately in accordance with the invention to a particle size of 90% less than 32 μm (500 mesh) and 15% thereof less than 5 μm (4500 mesh). Compared to pure natural gas, the fuel mixture reduces the cost of cogeneration and combined cycle power generation.

6. Clean Extended Fuel: Coal/Oil. A sulfur containing mixed fuel consisting of a sulfur containing liquid fuel, micronized coal, and a micronized limestone scrubbing agent has the solid components each ground separately in accordance with the invention to a particle size of 90% less than 32 μm (500 mesh) and 15% thereof less than 5 μm (4500 mesh) and has both solid components chemically modified in situ when ground. The surface modification allows a higher concentration of solids (up to 70%) in the liquid fuel mixture (with acceptable rheological properties) than would otherwise be possible.

7. Clean Liquid Fuel: Heavy Oil. A sulfur containing liquid fuel with a micronized limestone scrubbing agent has the scrubber ground in accordance with the invention to a particle size of 90% less than 30 μm (525 mesh) and 20% thereof less than 5 μm (4500 mesh), and has the surface of the scrubber chemically modified in situ when ground. The mixture allows the use of low cost sulfur containing fuel oils, bunker fuels, resid oils and heavy crudes resulting in lower cost heat and/or electricity from direct-fired boilers or combined cycle power generators while allowing in situ scrubbing of 90% of the $SO_2$ and $NO_x$.

8. Clean Coal/Water Slurry Fuel. A coal-water slurry fuel has the coal and limestone scrubbing agent each ground separately in accordance with the invention to a particle size of 90% less than 32 μm (500 mesh) and 15% thereof less than 5 μm (4500 mesh), and has the surface of the fuel component being chemically modified in situ when ground. This coal-water slurry fuel exhibits stable flames and shows fast combustion rates, is stable to storage, and tolerates a coal loading of up to 80%. The $SO_2$ and $NO_x$ are scrubbed in situ during the combustion process by the micronized limestone. Due to its high coal content and ease of utilization, such coal-water slurry fuels may be a useful means for transporting coal by pipeline, inland barge or marine tanker. Such coal-water slurry liquid coal fuel will exhibit savings in grinding, handling and transporting when compared with conventional lump coal. In addition, it will provide ease of storage in tank terminals. Such coal-water slurry fuel may be utilized as fuel for utility boilers or as feed stock for high-pressure coal gasifiers.

9. $SO_2/NO_x$ Control: Co-firing with Calcium Carbide Formation. Coal and limestone are ground in accordance with the invention for direct firing into the combustion chamber of a boiler, wherein the coal and limestone are each ground separately to a particle size of 70%–90% less than 30 μm (525 mesh) and 20%–70% thereof less than 5 μm (4500 mesh), thoroughly mixed in a molar ratio of coal: limestone= 4:1, and injected into the combustion chamber of a boiler. Calcium carbide forms at the flame temperature of the combustor (2,920° F. to 3,350° F.), which combines with the sulfur oxides and nitrogen oxides. The $SO_2$ is reduced by the calcium carbide to calcium sulfide (CaS) and the $NO_x$ is reduced to nitrogen ($N_2$) with a scrubbing effectiveness of 90%–99%. The particulates formed which may be collected downstream in a baghouse, greatly reduce (or eliminate) the need for downstream wet scrubbing of the exiting flue gases.

10. $SO_2/NO_x$ Control: Co-firing & Recirculation. Elimination of $SO_2$ and $NO_x$ created in the combustion of sulfur containing fuels, by cofiring the fuel with a micronized limestone scrubbing agent ground in accordance with the invention to a particle size of 80% less than 20 μm (875 mesh) and 20% thereof less than 10 μm (2000 mesh) and allowing the fuel gases to circulate at 1600° F. for completion of the scrubbing prior to exiting to the dust bag collector. At the above particle sizes the $SO_2$ and $NO_x$ are absorbed >99%.

11. $SO_2/NO_x$ Control: Co-firing & Hydration. Elimination of $SO_2$ and $NO_x$ created in the combustion of sulfur containing fuels, by co-firing the fuel with a micronized limestone scrubbing agent ground in accordance with the invention to a particle size of 80% less than 20 μm (875 mesh) and 20% thereof less than 5 μm (4500 mesh) and treating the resulting flue gases with a fine water mist to further activate the scrubbing agents and lower the temperature of the exhaust gases to the range 1400° F.–1800° F. prior to exiting to the dust bag collector. Applying a very fine water spray with compressed air converts the burnt lime (calcium oxide, CaO) present in the combustion gases into quenched lime (calcium hydroxide, $Ca(OH)_2$) which scrubs any residual $SO_2$ and $NO_x$. The foregoing method absorbs $SO_2$ and $NO_x$ >99+%.

12. $SO_2/NO_x$ Control: Sorbent Injection. As an alternative to co-firing micronized coal with a micronized limestone scrubbing agent, micronized limestone may be used for sorbent injection into the hot gases swirling above the combustion area. For sorbent injection the micronized limestone scrubbing agent is ground in accordance with the invention to a particle size of 80% less than 20 μm (875 mesh) and 20% thereof less than 10 μm (2000 mesh). For improved sorbent action, the micronized limestone may be further activated through the addition of micronized zinc ferrite or micronized iron oxide. The foregoing method absorbs $SO_2$ and $NO_x$ >96%.

13. $NO_x$ Control: Reburning. As an alternative for the control of $NO_x$, micronized coal, up to an amount equal to 20% of the total weight of the fuel used, is ground in accordance with the invention to a particle size of 80% less than 32 μm (500 mesh) and is injected immediately above the combustion zone for "reburning", which creates an oxygen deficient zone thereby eliminating residual $NO_x$ emission.

14. Improved Cement Clinker. Cement clinker is made, wherein the cement rocks (e.g., limestone, clays, stones/silicates, iron ore and other ingredients) are ground in accordance with the invention to a particle size of 90% less than 32 μm (500 mesh) and 15% thereof less than 5 μm (4500 mesh), such cement rocks being blended and kiln fired into finished cement clinker. Clinker made with superfine- and ultrafine-sized cement rock components as specified above is of higher and more consistent quality than clinker made without such preparation of its reacting components.

15. Improved Cements. Cement particles have their surfaces chemically modified in situ while undergoing grinding in accordance with the invention. The surface modification of micronized cement improves strength and causes a faster development of final physical properties in concrete formulations.

16. Improved Preparation of Cement. The size reduction of cement clinker, wherein the cement product is ground in accordance with the invention to a particle size of 90% less than 30 μm (525 mesh) and 20% thereof less than 5 μm (4500 mesh) with 10% thereof less than 2 μm. Cement with superfine and ultrafine particles as specified above displays higher strength, superior aging and faster curing in concrete formulations.

17. New Concrete Formulations. Volcanic glasses (e.g, volcanic pozzolan, ash, tuff or rhyolite) may be converted into micronized glasses, e.g, rhyolite is ground in accordance with the invention to a particle size of 80% less than 32 μm (500 mesh) and 20% thereof less than 10 μm (2000 mesh). The micronized volcanic glasses when used in cement formulations produce a concrete with high early strength and fast cure out to yield compression sets of 4000 psi or higher.

Fly ash, a power plant by-product, may be micronized in accordance with the present invention and used in high strength concrete formulations in admixture with portland cement, silica fume and suitable aggregates, yielding a concrete with a compression set of 17,000 to 20,000 psi. The upgrading of the fly ash to a premium micronized product should result in a lower production cost for electric power.

18. Recycling of Concrete. Used concrete is converted into a micronized recycled concrete mix in accordance with the present invention through dry grinding to particle sizes appropriate for its use in new concrete formulations in combination with fresh cement as an additional binder. The ability to recycle at a construction site recovered concrete results in significant savings in materials, transport, disposal and labor costs.

19. New Construction Materials. Size reduction of granite, quartz, wollastonite or other hard silicates and igneous rocks, wherein the pulverized products are ground in accordance with the present invention to a particle size of 90% less than 32 μm (500 mesh) and 20% thereof less than 5 μm (4500 mesh), such products being reacted with a binder to yield new construction materials. Products prepared from micronized hard rocks exhibit superior strength and other physical properties compared to conventional products in the building industry, such as mortars, bricks, blocks, tiles and panels.

High strength concrete formulations, prepared with the addition of silica fume and fly ash as ingredients, exhibit high compression sets, but lack in ductility, become brittle and show decreased shear strength. Replacement of the common aggregates used in these formulations with micronized hard rock prepared in accordance with the present invention overcomes this deficiency and yields a high strength concrete with high compression set and high shear strength.

20. New Insulating Materials. Cellular concrete foams made with micronized rhyolite or other volcanic glasses incorporate the closed cell structures which are inherent in these minerals due to entrapment of volcanic gas bubbles. Such foams exhibit high insulating values and added structural strength (k values of 30 to 40 and compressive strengths up to 2000 psi). In addition to being fully fire proof, micronized rhyolite-cellular concrete foam formulations are excellent thermal and acoustic insulators as well as impact absorbers. Such low-cost foams can replace expensive polyurethane foam insulation which releases poisonous gases (e.g, hydrogen cyanide) upon exposure to fire. Such foams also can reduce the requirements for steel reinforcement in high rise structures, may be used for the erection of low-cost insulated warehouses, and may serve as foundations for road beds, thus reducing maintenance costs associated with damage to roads caused by temperature fluctuations.

21. Production of Iron Carbide and Sponge Iron. For the purpose of converting iron ore into iron carbide powder, dry iron ore is ground in accordance with the invention to a micronized product having a particle size of 90% less than 32 μm (500 mesh) and 15% thereof less than 5 μm (4500 mesh). The micronized iron ore is mixed with micronized coal having a particle size of 90% less than 30 μm (525 mesh) and 15% thereof less than 5 μm (4500 mesh) and the mixture is processed through a reducing furnace to yield iron carbide. The conversion of iron ore to iron carbide at the source of its mining results in a product with much higher iron content ($Fe_3C$ with 93.22% Fe vs. $Fe_2O_3$ with 69.94% Fe), thereby reducing transportation costs to market. The iron carbide is usable directly in the electric furnace process of steel making by serving as a replacement of scrap iron in the steel minimills hence allowing bypass of the expensive step of blast furnace reduction of pelletized iron ore.

For the purpose of converting iron ore into sponge iron, dry iron ore is ground in accordance with the invention to a micronized product having a particle size of 60% less than 32 μm (500 mesh). The micronized iron ore is processed through a reduction furnace with gasified coal prepared from micronized coal and oxygen. The resulting sponge iron is a synthetic scrap iron useful in replacing the scrap iron for production of steel in electric furnaces of the minimills.

22. Micronized Coal for Blast Furnaces. Micronized coal ground in accordance with the invention to a particle size of 80% less than 32 μm (500 mesh) may be used directly in conventional blast furnaces for the reduction of iron ore by introducing such micronized coal into the tuyeres of said furnace. Up to 40% of the coke and all the natural gas used as auxiliary fuel in such process may be replaced by low cost high sulfur micronized coal, the sulfur originating from such coal being scavenged into the blast furnace slag. By introducing micronized coal and oxygen into the blast furnace process, up to 90% of the coke can be replaced by micronized high sulfur coal prepared in accordance with the present invention and results in a lower cost of steel production.

23. Strategic Metals Recovery. Availability of low cost micronized ores with the present invention and low cost hydrogen from gasification of high sulfur micronized coals allows the recovery of strategic metals (manganese, nickel, cobalt, tin, titanium, chromium, molybdenum, tungsten and vanadium) from their low grade ores. The low grade strategic metal ores are ground in accordance with the invention to a particle size of 90% less than 30 μm (525 mesh). These micronized powders are processed with hydrogen in a reducing furnace thereby liberating the strategic metal particles which may be separated by gravity from the undesirable ore gangue.

24. Dry Separation of Precious Metals. Size reduction in accordance with the invention may be used in the separation of precious metals from high clay containing placers, black sands or their concentrates and in recovery of these metals from their refractory ores. As a dry process, it represents savings in water usage and water recycle and thereby results in a lowering of processing costs for the recovery of precious metals, particularly with deposits situated in arid climate regions.

25. Liberation of Gold & Platinum from Ores. Size reduction in accordance with the invention may be used to liberate elemental gold from hard quartz or silicate ores, and liberate elemental platinum from encapsulating magnetite nodules. The liberated gold may be beneficiated by tabling or chemical leaching and the platinum may be upgraded by wet magnetic separation.

26. Production of Hydrogen. Coal and limestone are each ground separately in accordance with the invention for combustion with oxygen in the presence of water in a high-pressure gasifier to produce a mixture of carbon monoxide (CO) and hydrogen ($H_2$), wherein the coal is ground to a particle size of 80% less than 32 μm (500 mesh) and the limestone is ground to a particle size of 80% less than 30 μm (525 mesh) and 25% thereof less than 5 μm. The use of micronized coal decreases the reaction time and permits better control of the reaction, thereby reducing the cost of hydrogen production below that of using larger coal feed. The foregoing represents one of the lowest cost methods of hydrogen production.

27. Combustion Gas Clean Up for Direct Coal-Fired Turbines. The combustion gases of a direct coal-fired turbine burning 75 μm (200 mesh) coal pass horizontally through a rotating semipermeable means in accordance with the present invention. The semipermeable means is an assembly with a rotating screen placed between the combustor isle and the gas turbine, with a trap below the rotating screen. Most of the hot molten ash particulates formed from the coal are removed from the gas stream with negligible loss of pressure and lowering of temperature, and the ash remaining in the gas stream is reduced in size such that there is no damage to the vanes or blades of the turbine. Similarly, the rotating semipermeable means may be used to effect hot gas cleanup when sulfur sorbents, alkali sorbents, or ash modifiers are injected into the hot gas stream to avoid erosion and corrosion of the gas turbine and to meet environmental emission standards. The effectiveness of clean up may be enhanced by the additional use of a centrifugal expelling fan after the passage of hot gases through the rotating semipermeable means.

28. Combustion Gas Clean Up for PFBC. The combustion gases exiting a pressurized fluidized bed combustor containing ash and alkali particles are cleaned up by allowing the hot gases to pass through an arrangement containing a rotating semipermeable means in accordance with the present invention, prior to entering the gas turbine, thereby eliminating the need for expensive and fragile ceramic cross-flow filters. The effectiveness of clean up can be enhanced by using a centrifugal expelling fan downstream from the rotating semipermeable means to eliminate the residual solids in the hot gas stream.

29. Combustion Gas Clean Up for Coal-Fired Boilers. A rotating semipermeable means in accordance with the present invention is made of tungsten and is placed horizontally in the combustion chamber within the zone of the boiler tubes of a coal-fired boiler burning 75 μm (200 mesh) coal. The larger embers are rejected by the rotating semipermeable means and retained within the combustion chamber long enough to convey additional heat to the boiler tubes such that the carbon burnout is increased to 99% and the dry flue gas loss is decreased below 8%.

30. Manufacture of Calcium Carbide. Limestone and coal are ground separately in accordance with the invention, each to a particle size of 80% less than 30 μm (525 mesh) and 20%–60% thereof less than 5 μm (4500 mesh). A micronized coal flame is initiated in a cyclonic combustor and its temperature maintained in the range 2,920° F.–3,350° F. The micronized limestone and micronized coal are thoroughly mixed in a molecular ratio of limestone: coal=1:4, and the mixture is blown into the combustion zone where calcium carbide is formed. The calcium carbide so formed is removed by an airstream through a pipe assembly wherein the reaction products are cooled to 300° F., after which the calcium carbide powder is separated from the entraining air stream in a cyclone.

The preceding specification describes, by way of illustration and not of limitation, preferred embodiments of the invention. Equivalent variations of the described embodiments will occur to those skilled in the art. Such variations, modifications, and equivalents are within the scope of the invention as recited with greater particularity in the following claims, when interpreted to obtain the benefits of all equivalents to which the invention is fairly entitled.

What is claimed is:

1. A method for the dry grinding of solids, comprising steps of:

directing solid particles generally upwardly into a vortex grinding zone; and grinding the upwardly directed solid particles in the vortex grinding zone by passing a portion of the particles through the vortex grinding zone, the vortex grinding zone comprising at least one successively vertically disposed vortex grinding stage comprising passing particles upwardly through at least one of rotating semipermeable means and an annular gap defined by a flat surface stationary plate with a circular aperture therein and a rotating circular no-apertured disc in the circular aperture.

2. The method according to claim 1, wherein the step of passing particles upwardly through said rotating semipermeable means comprises passing particles through an assembly containing a rotating screen.

3. The method according to claim 2, wherein the step of passing particles through said rotating screen comprises passing particles through a screen no coarser than 2.5 mesh.

4. The method according to claim 3, wherein the screen has a mesh size in the range from 2.5 to 60.

5. The method according to claim 3, wherein the screen has a mesh size in the range from 4 to 10.

6. The method according to claim 1, wherein the step of passing the particles through the annular gap comprises passing the particles through an annular gap having a width of from 0.5 to 6 inches.

7. The method according to claim 1, wherein each stage comprises passing the particles through the rotating semipermeable means and thereafter through the annular gap.

8. The method according to claim 7, further comprising rotating the rotating semipermeable means and rotating disc on a common shaft.

9. The method according to claim 1, further comprising the step of externally recycling by rotating a centrifugal expelling fan downstream of the rotating semipermeable means and providing a recycle channel receptive of particles from the rotating expelling fan and having an outlet below the at least one vortex grinding stage.

10. The method according to claim 1, further comprising the step of removing particles above the grinding zone.

11. The method according to claim 10, wherein the step of removing comprises rotating at least one centrifugal expelling fan downstream of the at least one grinding stage.

12. The method according to claim 10, wherein the step of removing comprises removing in two vertically disposed removing stages for removing particles of successively smaller sizes.

13. The method according to claim 1, further comprising the step of initially grinding coarse particles into fine particles before directing the fine particles into the vortex grinding zone.

14. The method according to claim 1, further comprising the step of initially coarse and fine grinding by feeding solids into a chamber, forming a fluidized bed of the solids in the chamber by directing air upwardly in the chamber and creating a controlled vortexing in the fluidized bed grinding zones to effect autogenous grinding.

15. The method according to claim 14, further comprising the step of internally recycling by inserting a rotating semipermeable means in the initial coarse grinding zone, and rotating said semipermeable means at a sufficient speed to prevent the passage of a portion of the oversize particles therethrough and internally recycling said particles to the initial coarse grinding zone.

16. The method according to claim 14, further comprising the step of externally recycling particles into the fluidized bed.

17. The method according to claim 14, wherein the step of creating controlled vortexing comprises using rotors.

18. The method according to claim 1, comprising a plurality of vortex grinding stages and further comprising the step of externally recycling particles to a previous stage.

19. The method according to claim 1, wherein the step of grinding is carried out in a non-reactive atmosphere in the presence of a chemical reagent to effect controlled surface modification.

20. A process for treating combustion gases for removal of $SO_x$ and $NO_x$ therein, comprising the steps of:

grinding coal and limestone to particles sizes of 70%–90% less than 30 μm and 20%–70% thereof less than 5 μm;

introducing said ground coal and ground limestone in a molecular ratio of at least 4:1 into a chamber at a temperature of between 2,850° F. and 3,350° F. in order to form $CaC_2$; and mixing the formed $CaC_2$ with combustion gases to remove $SO_x$ and $NO_x$ from the combustion gases by the formation of CaS and $N_2$.

21. An apparatus for the dry grinding of solids, comprising:

means forming a vortex grinding zone including at least one successively vertically disposed vortex grinding stage for the grinding of solid particles; and means for directing solid particles generally upwardly into the vortex grinding zone;

wherein said at least one vortex grinding stage comprises at least one of rotatable semipermeable means and means forming an annular gap comprising a flat surfaced stationary plate having a circular aperture therein and a rotatable circular non-apertured disc in the circular aperture and wherein the rotatable semipermeable means and the annular gap are configured to pass a portion of the upwardly directed particles therethrough; and wherein each vortex grinding stage contains a rotatable expelling fan downstream from the rotatable semipermeable means to sort out the size of the upwardly directed particles.

22. The apparatus according to claim 21, wherein the rotatable semipermeable means comprises an assembly containing a rotatable screen.

23. The apparatus according to claim 22, wherein the rotatable screen comprises a screen no coarser than 2.5 mesh.

24. The apparatus according to claim 23, wherein the screen has a mesh size in the range from 2.5 to 60.

25. The apparatus according to claim 23, wherein the screen has a mesh size in the range from 4 to 10.

26. The apparatus according to claim 21, wherein the annular gap has a width of from 0.5 to 6 inches.

27. The apparatus according to claim 21, wherein each stage comprises the semipermeable means and means forming the annular gap and the centrifugal eliminating fan downstream of the semipermeable means.

28. The apparatus according to claim 27, further comprising means for rotating the rotatable semipermeable means, the rotatable disc and rotatable eliminating fan on a common shaft.

29. The apparatus according to claim 21, further comprising means for internally recycling including means for rotating said semipermeable means at a sufficient speed to prevent the passage of a portion of the particles therethrough.

30. The apparatus according to claim 29, further comprising means for externally recycling comprising a rotatable centrifugal expelling fan downstream of the rotatable semipermeable means and a recycle channel receptive of particles from the rotating expelling fan and having an outlet below the at least one vortex grinding stage.

31. The apparatus according to claim 21, further comprising means for removing particles above the vortex grinding zone.

32. The apparatus according to claim 31, wherein the means for removing comprises means for rotating at least one centrifugal expelling fan downstream of the at least one vortex grinding stage.

33. The apparatus according to claim 21, further comprising means for initially grinding coarse particles into fine particles before directing the fine particles into the vortex grinding zone.

34. The apparatus according to claim 32, further comprising means for initially grinding comprising means for feeding solids into a chamber, means for forming a fluidized bed of the solids in the chamber including means for directing air upwardly in the chamber and means for creating controlled vortexing in the fluidized bed to effect autogenous grinding.

35. The apparatus according to claim 34, further comprising means for externally recycling particles into the fluidized bed.

36. The apparatus according to claim 34, wherein the means for creating controlled vortexing comprises rotors.

37. The apparatus according to claim 31, wherein the means for removing comprises means for removing in two vertically disposed removing stages for removing particles of successively smaller sizes.

38. The apparatus according to claim 21, comprising a plurality of grinding stages and means for externally recycling particles to a previous stage.

39. A method for the dry grinding of solids, comprising the steps of feeding solids into a chamber; forming a fluidized bed of the solids in the chamber by directing air upwardly in the chamber and by creating air movement sideways through centrifugal forces in the chamber to compel the solids to move to the periphery of the chamber, said bed thereby being formed into a broad free floating annulus of solids at the periphery of the chamber; and creating a controlled vortexing in the fluidized bed to effect autogenous grinding of the solids while avoiding direct impacting of the machinery of the mill on the solids in the grinding zone of the broad free floating annulus.

40. The method according to claim 39, further comprising the step of removing particles above the fluidized bed.

41. The method according to claim 40, wherein the step of removing comprises rotating at least one centrifugal expelling fan downstream of the fluidized bed.

42. The method according to claim 39, wherein the step of creating a controlled vortexing comprises rotating rotors.

43. The method according to claim 39, wherein the grinding is carried out in a non-reactive atmosphere in the presence of a chemical reagent to effect a controlled surface modification.

44. An apparatus for the dry grinding of solids comprising: means forming a chamber; means for feeding solids into the chamber; means for forming a fluidized bed of the solids in the chamber including means for directing air upwardly in the chamber; means for creating centrifugal forces to generate air movement sideways in the chamber to compel the solids to move to the periphery of the chamber to form the fluidized bed into a broad free floating annulus; and means for creating a controlled vortexing in the chamber to effect autogenous grinding of the solids while avoiding the direct impacting of the machinery of the mill on the solids in the broad free floating annulus of the grinding zone.

45. The apparatus according to claim 44, further comprising means for removing particles above the fluidized bed.

46. The apparatus according to claim 45, wherein the means for removing comprises at least one rotatable centrifugal expelling fan downstream of the fluidized bed.

47. The apparatus according to claim 44, wherein the means for creating a controlled vortexing comprises rotatable rotors.

48. A method for the dry grinding of solids, comprising the steps of feeding solids into a chamber; forming a fluidized bed of the solids in the chamber by directing air upwardly in the chamber; creating a controlled vortexing in the fluidized bed to effect autogenous grinding, removing the particles above the fluidized bed, and recycling removed particles into the fluidized bed.

49. The method according to claim 48, wherein the step of recycling comprises rotating a centrifugal expelling fan downstream of the fluidized bed and providing a recycle channel receptive of particles from the rotating fan and having an outlet into the fluidized bed.

50. A method for the dry grinding of solids, comprising the steps of feeding solids into a chamber; forming a fluidized bed of the solids in the chamber by directing air upwardly in the chamber; creating a controlled vortexing in the fluidized bed to effect grinding; and removing particles above the fluidized bed in two vertically disposed removing stages for removing particles of successively smaller sizes.

51. An apparatus for the dry grinding of solids comprising: means forming a chamber; means for feeding solids into the chamber; means for forming a fluidized bed of the solids in the chamber including means for directing air upwardly in the chamber and means for creating a controlled vortexing in the fluidized bed to effect autogenous grinding; means for removing particles above the fluidized bed; and means for recycling the removed particles into the fluidized bed.

52. The apparatus according to claim 51, wherein the means for recycling comprises a rotatable centrifugal expelling fan downstream of the fluidized bed and a recycle channel receptive of particles from the rotating fan and having an outlet into the fluidized bed.

53. An apparatus for the dry grinding of solids, comprising: means forming a chamber; means for feeding solids into the chamber; means for forming a fluidized bed of the solids in the chamber including means for directing air upwardly in the chamber and means for creating a controlled vortexing in the fluidized bed to effect autogenous grinding, and means for removing particles above the fluidized bed comprising means for feeding vertically disposed removing stages for removing particles of successively smaller sizes.

* * * * *